US011679920B2

(12) United States Patent
Ball et al.

(10) Patent No.: US 11,679,920 B2
(45) Date of Patent: Jun. 20, 2023

(54) CARTON AND BLANK THEREFOR

(71) Applicant: WestRock Packaging Systems, LLC, Atlanta, GA (US)

(72) Inventors: Nathaniel B. Ball, Richmond, VA (US); Meng-Chuan Wu, Fayetteville, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 340 days.

(21) Appl. No.: 16/708,529

(22) Filed: Dec. 10, 2019

(65) Prior Publication Data

US 2020/0216246 A1 Jul. 9, 2020

Related U.S. Application Data

(60) Provisional application No. 62/788,291, filed on Jan. 4, 2019.

(51) Int. Cl.

| | |
|---|---|
| ***B65D 71/36*** | (2006.01) |
| ***B65D 5/18*** | (2006.01) |
| ***B65D 5/72*** | (2006.01) |
| ***B31B 50/84*** | (2017.01) |
| *B31B 100/00* | (2017.01) |

(52) U.S. Cl.

CPC ..... *B65D 71/36* (2013.01); *B31B 50/84* (2017.08); *B65D 5/18* (2013.01); *B65D 5/725* (2013.01); *B31B 2100/0024* (2017.08); *B65D 2571/0066* (2013.01); *B65D 2571/00141* (2013.01); *B65D 2571/00444* (2013.01); *B65D 2571/00561* (2013.01); *B65D 2571/00728* (2013.01)

(58) Field of Classification Search

CPC ..... B65D 71/36; B65D 5/18; B65D 5/725; B65D 2571/00444; B65D 2571/00561; B65D 2571/0066; B65D 2571/00728; B65D 2571/00141; B65D 2571/0058; B65D 2571/00574; B65D 2571/00907; B65D 2303/00; B31B 50/84

USPC ..... 206/427, 430, 821, 160, 194, 197, 199, 206/739; 229/112, 242, 109, 117.12, 229/117.13; 220/906; 493/88; 221/305

See application file for complete search history.

(56) References Cited

U.S. PATENT DOCUMENTS

| | | | | |
|---|---|---|---|---|
| 2,115,673 A | | 4/1938 | Stompe | |
| 4,498,581 A | | 2/1985 | Dutcher | |
| 5,427,242 A | * | 6/1995 | Oliff | B65D 71/36 206/160 |

(Continued)

FOREIGN PATENT DOCUMENTS

| | | |
|---|---|---|
| GB | 1395644 | 5/1975 |

*Primary Examiner* — Christopher R Demeree

(74) *Attorney, Agent, or Firm* — Brian J. Goldberg

(57) ABSTRACT

Aspects of the disclosure relate to a package, a carton, and a blank for forming the carton. An aspect of the invention provides a package comprising a carton or article carrier loaded with one or more articles. The package comprises a group of generally cylindrical articles each having an end and a cylindrical side. The carton is disposed at least partially around the group of articles B. The carton comprises a plurality of panels including: a bottom wall, a top wall, first and second opposed side walls and first and second opposed end walls. The group of articles are arranged in a plurality of rows of articles comprising a first row and a second row.

16 Claims, 15 Drawing Sheets

(56) References Cited

U.S. PATENT DOCUMENTS

| | | | | |
|---|---|---|---|---|
| 5,687,847 | A * | 11/1997 | Culpepper | B65D 71/246 53/157 |
| 6,869,009 | B2 | 3/2005 | Sutherland et al. | |
| 6,997,316 | B2 * | 2/2006 | Sutherland | B65D 71/36 206/427 |
| 7,874,477 | B2 | 1/2011 | Sutherland et al. | |
| 8,087,570 | B2 | 1/2012 | Ho Fung | |
| 8,584,926 | B2 * | 11/2013 | Bull | B65D 71/36 229/109 |
| 9,499,297 | B2 | 11/2016 | Bentley et al. | |
| 9,938,035 | B2 * | 4/2018 | Block | B65D 25/30 |
| 10,220,976 | B2 * | 3/2019 | Zacherle | B65D 5/5445 |
| 10,259,611 | B2 * | 4/2019 | Grace | B65D 5/4266 |
| 2016/0221737 | A1 | 8/2016 | Spivey, Sr. et al. | |

* cited by examiner

CARTON AND BLANK THEREFOR

TECHNICAL FIELD

The present invention relates to product packaging, to article carriers or cartons, and to blanks for forming the same. More specifically, but not exclusively, the invention relates to a carton having a dispensing feature for accessing the contents of the carton.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide a carton or article carrier having a dispensing feature for accessing the contents of the carrier. It is desirable that the articles are retained within the interior of carton when the dispensing feature is deployed.

The present invention seeks to provide an improvement in the field of cartons and carton blanks, typically formed from paperboard or the like.

SUMMARY

A first aspect of the disclosure provides a package comprising a carton or article carrier loaded with one or more articles. The package comprises a group of generally cylindrical articles each having an end and a cylindrical side. The carton is disposed at least partially around the group of articles B. The carton comprises a plurality of panels including: a bottom wall, a top wall, first and second opposed side walls and first and second opposed end walls. The group of articles are arranged in a plurality of rows of articles comprising a first row and a second row. The first row extends along the bottom wall such that the cylindrical sides of the articles of the first row are disposed in contact with the bottom wall and such that the ends of the articles of the first row are disposed adjacent to one of the opposed side walls. The second row is disposed on the first row such that the ends of the articles of the second row are disposed adjacent to one of the opposed side walls and are nested with the articles of the first row. Each of the first and second rows includes a pair of first and second endmost articles at opposite ends of the respective row. The first end wall of the carton is disposed in contact with the first endmost articles of the first and second rows. The second end wall of the carton is disposed in contact with the second endmost articles of the first and second rows. The carton further comprises an article dispensing feature which comprises a removable panel detachably connected at least in part to one of the opposed side walls so as to define a dispenser opening in said one of the opposed side walls. The articles of the group may exit from the carton through the dispenser opening. The dispenser opening is positioned and sized such that the ends of at least one of the articles in the first row and of at least another one of the articles in the group are exposed to view for removal through the dispenser opening.

Optionally, the second row may comprise at least one more article than the first row.

Optionally, the first end wall comprises a first portion and a second portion, the first portion is oblique with respect to the bottom wall and is in contact with a first endmost article of the first row.

Optionally, the first portion extends between the bottom wall and the second portion, the second portion being disposed generally perpendicular to the bottom wall and being in contact with the first endmost article of the second row.

Optionally, the second end wall comprises a first portion and a second portion, the first portion of the second end wall is oblique with respect to the bottom wall and is in contact with the second endmost article of the first row.

Optionally, the first portion of the second end wall extends between the bottom wall and the second portion of the second end wall, the second portion of the second end wall is disposed generally perpendicular to the bottom wall and is in contact with the second endmost article of the second row.

Optionally, the group of articles further comprises a third row disposed on the second row such that the articles of the third row are disposed at the ends thereof adjacent to the side wall and are nested with the articles of the second row.

Optionally, the group of articles may further comprise a third row disposed on the second row such that the articles of the third row are disposed at the ends thereof adjacent to the side wall and are in vertical alignment respectively with the articles of the second row and wherein the at least another one of the articles in the group is at least another one of the articles of the first row.

Optionally, the dispenser opening has a maximum length extending along the side wall, the maximum length being equal to or greater than twice the maximum diameter of each article of the group.

Optionally, the dispenser opening has a width extending perpendicularly to the maximum length along the side wall, the width being equal to or greater than the maximum diameter.

A second aspect of the disclosure provides a blank for forming a carton for packaging a group of articles arranged in two or more rows. The blank comprises a plurality of primary panels for defining an interior of the carton. The plurality of panels comprises: a bottom wall, a top wall, first and second opposed side walls and first and second opposed end walls. The blank further comprises: an article dispensing feature having a removable panel detachably connected at least in part to one of the opposed side walls so as to define a dispenser opening in said one of the opposed side walls. The dispenser opening is positioned and sized such that the ends of at least one article in the first row and of at least another one of the articles in the group are exposed to view for removal through the dispenser opening such that in a setup carton the articles of the group may exit from the carton through the dispenser opening.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, carton and blank are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, cartons and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
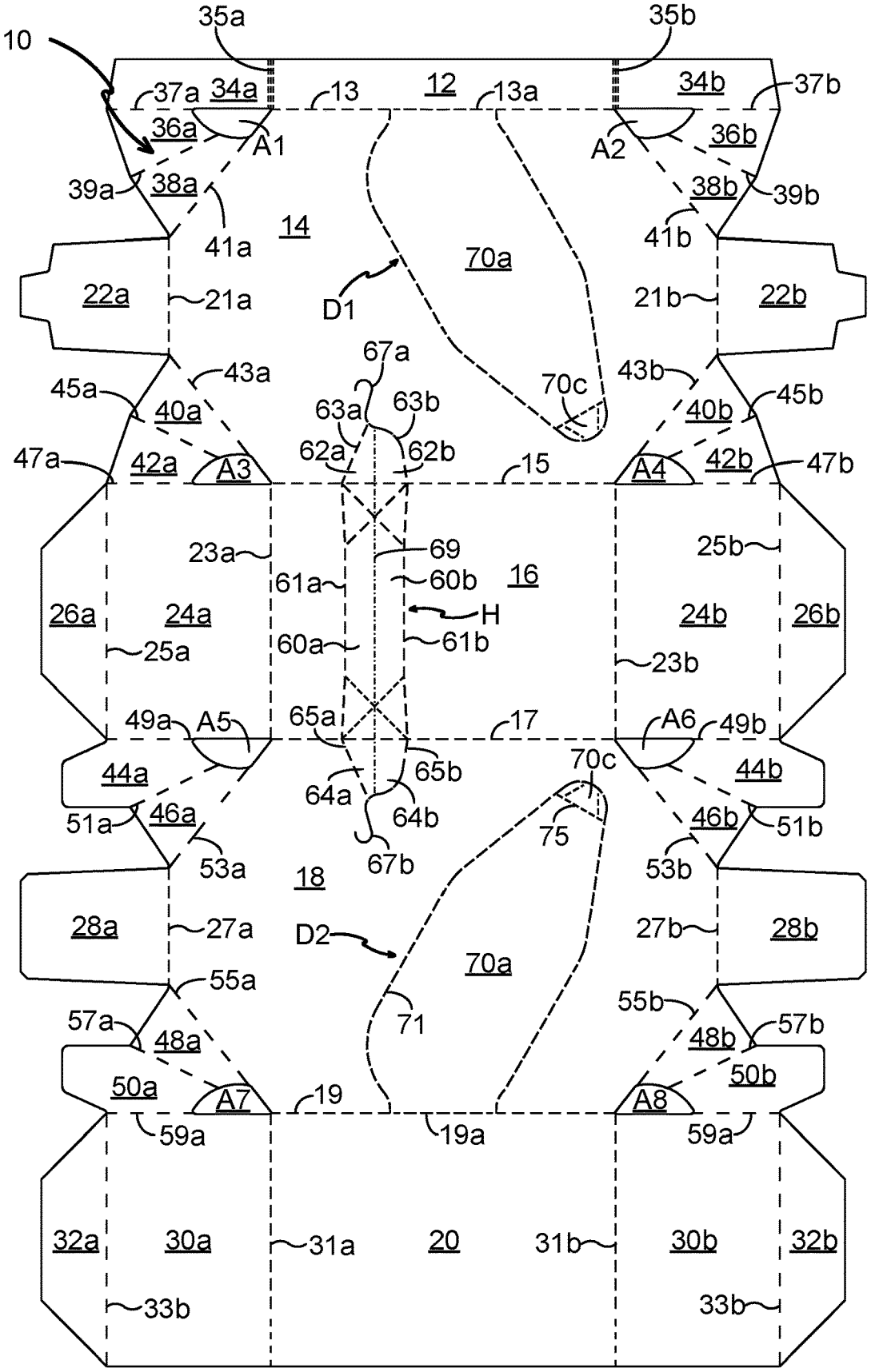
FIG. 1 is a plan view from above of a blank for forming an article carrier according to a first embodiment.
Figure 2:
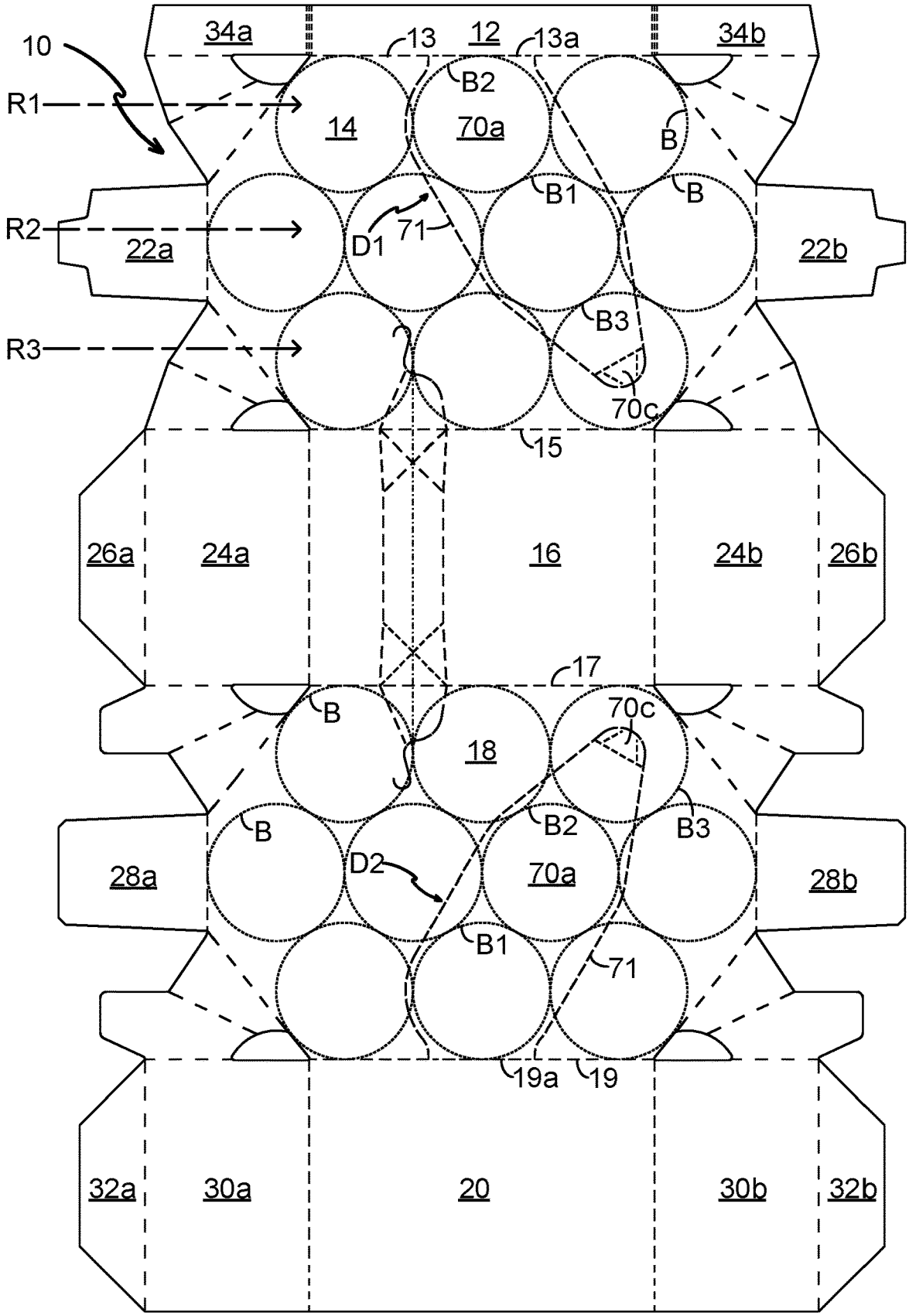
FIG. 2 is a plan view from above of the blank of FIG. 1 showing an arrangement of a plurality of articles with respect to top and bottom panels of the blank.
Figure 3:
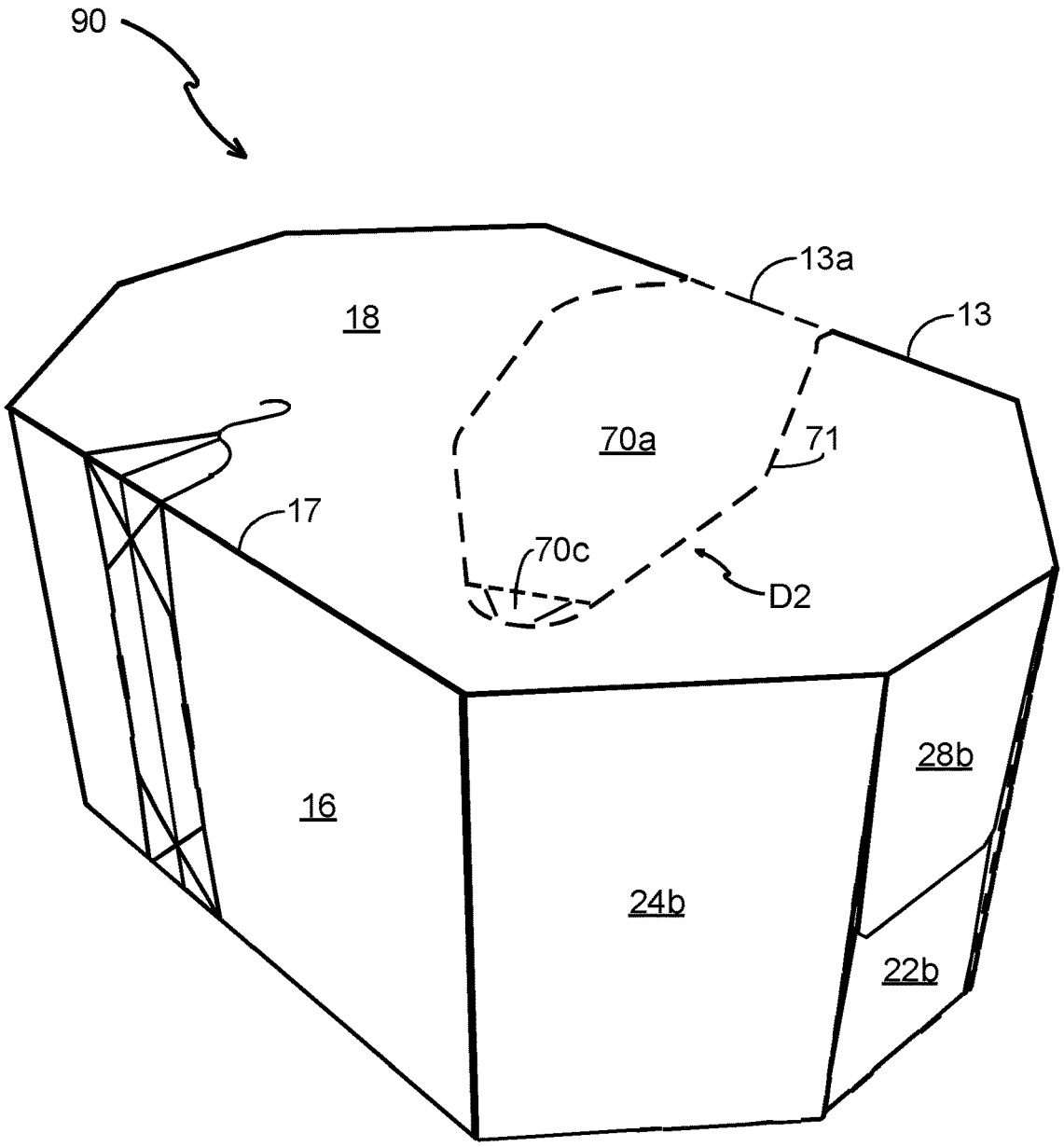
FIG. 3 is a perspective view of an article carrier formed from the blank of FIG. 1.

Referring to FIGS. 1 and 2, there are shown plan views of a blank 10, according to an embodiment of the disclosure, capable of forming a package in the form of an article carrier or carton 90, as shown in FIG. 3, for containing and carrying a group of primary products such as, but not limited to, cans, hereinafter referred to as articles B.

Figure 5:
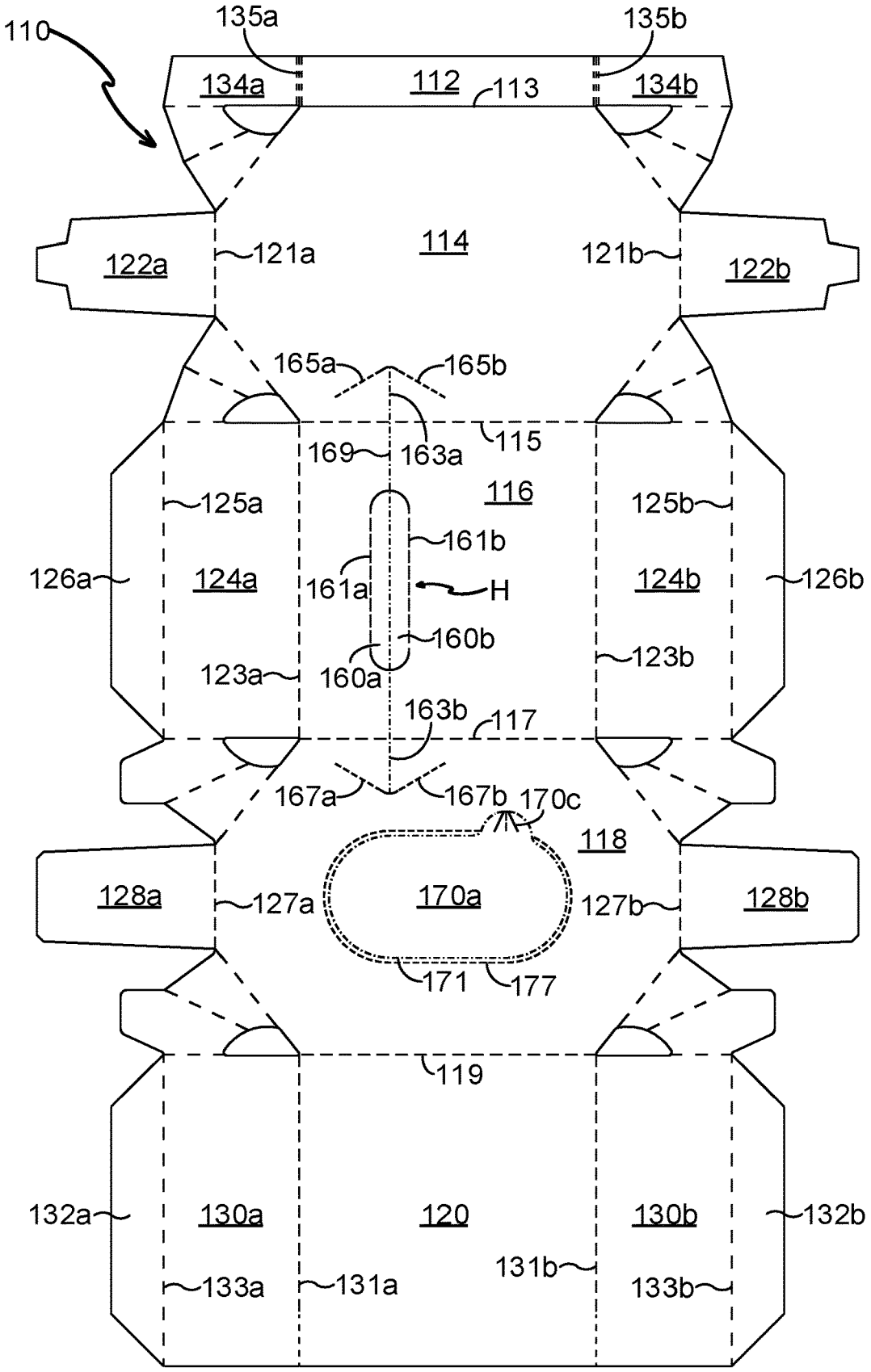
FIG. 5 is a plan view from above of a blank for forming an article carrier according to a second embodiment.
Figure 7:
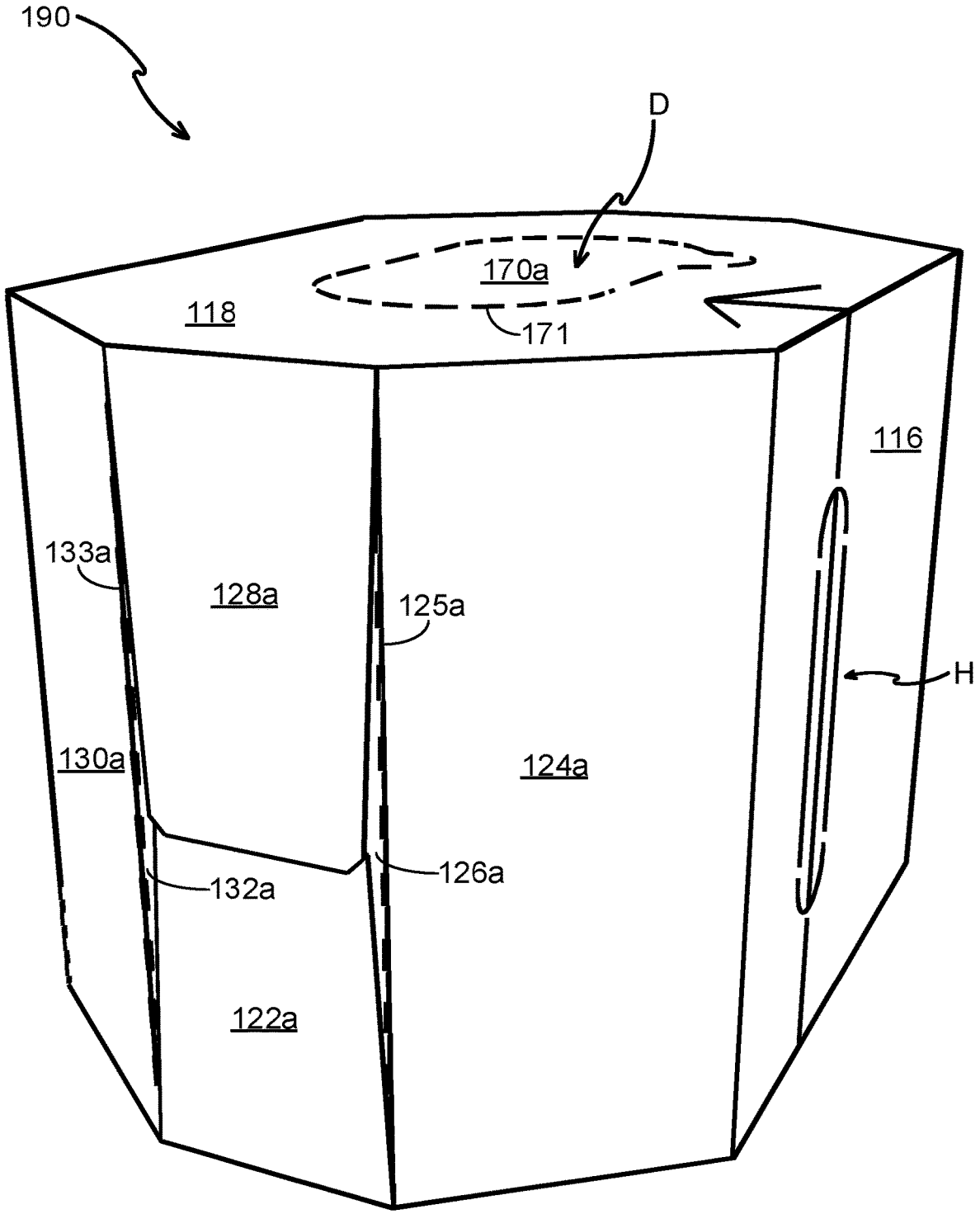
FIG. 7 is a perspective view of an article carrier formed from the blank of FIG. 5.

FIG. 5 shows a plan view of a blank 110, according to another embodiment of the disclosure, capable of forming an article carrier or carton 190, as shown in FIG. 7.

Figure 8:
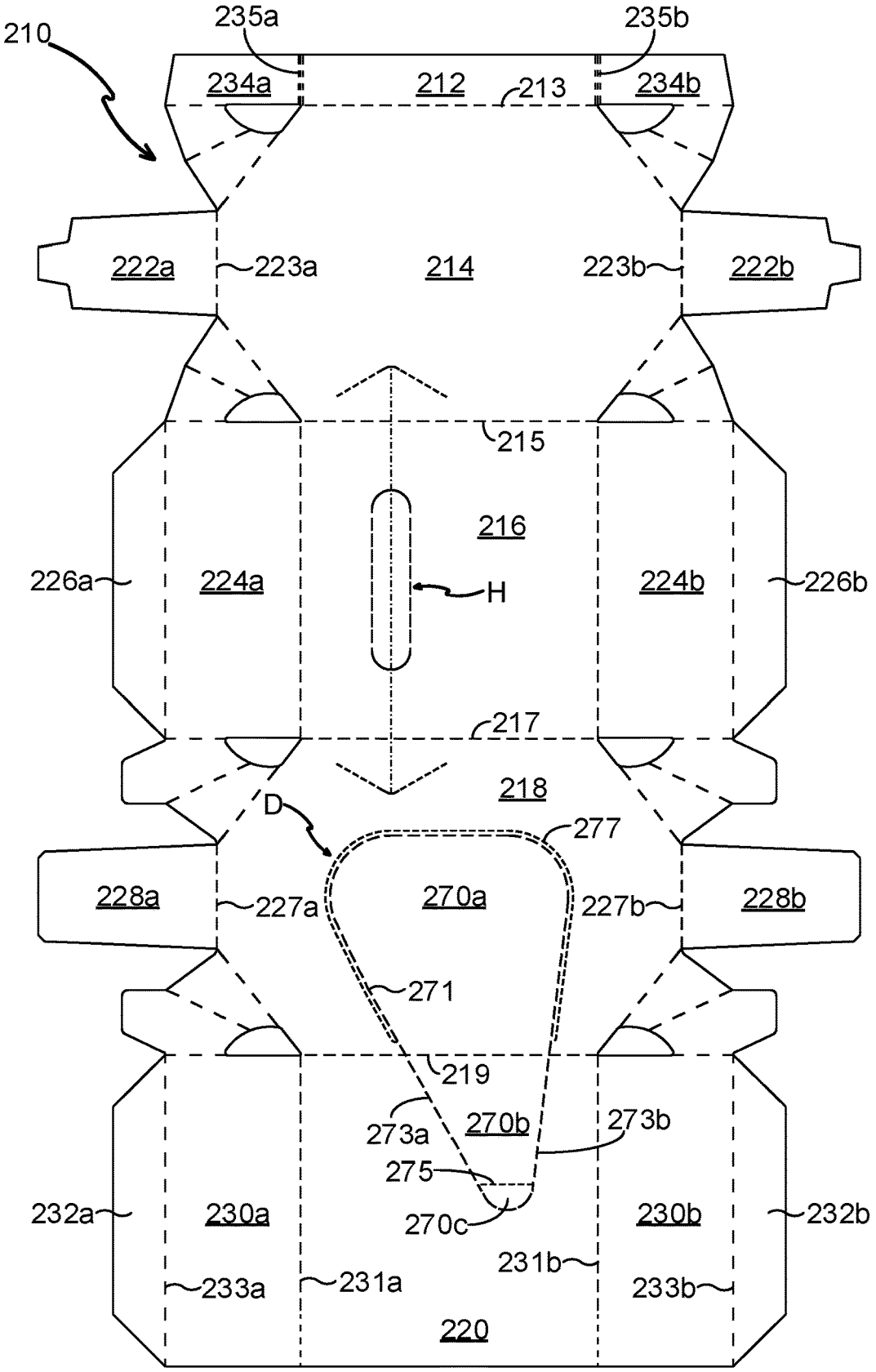
FIG. 8 is a plan view from above of a blank for forming an article carrier according to a third embodiment.
Figure 10:
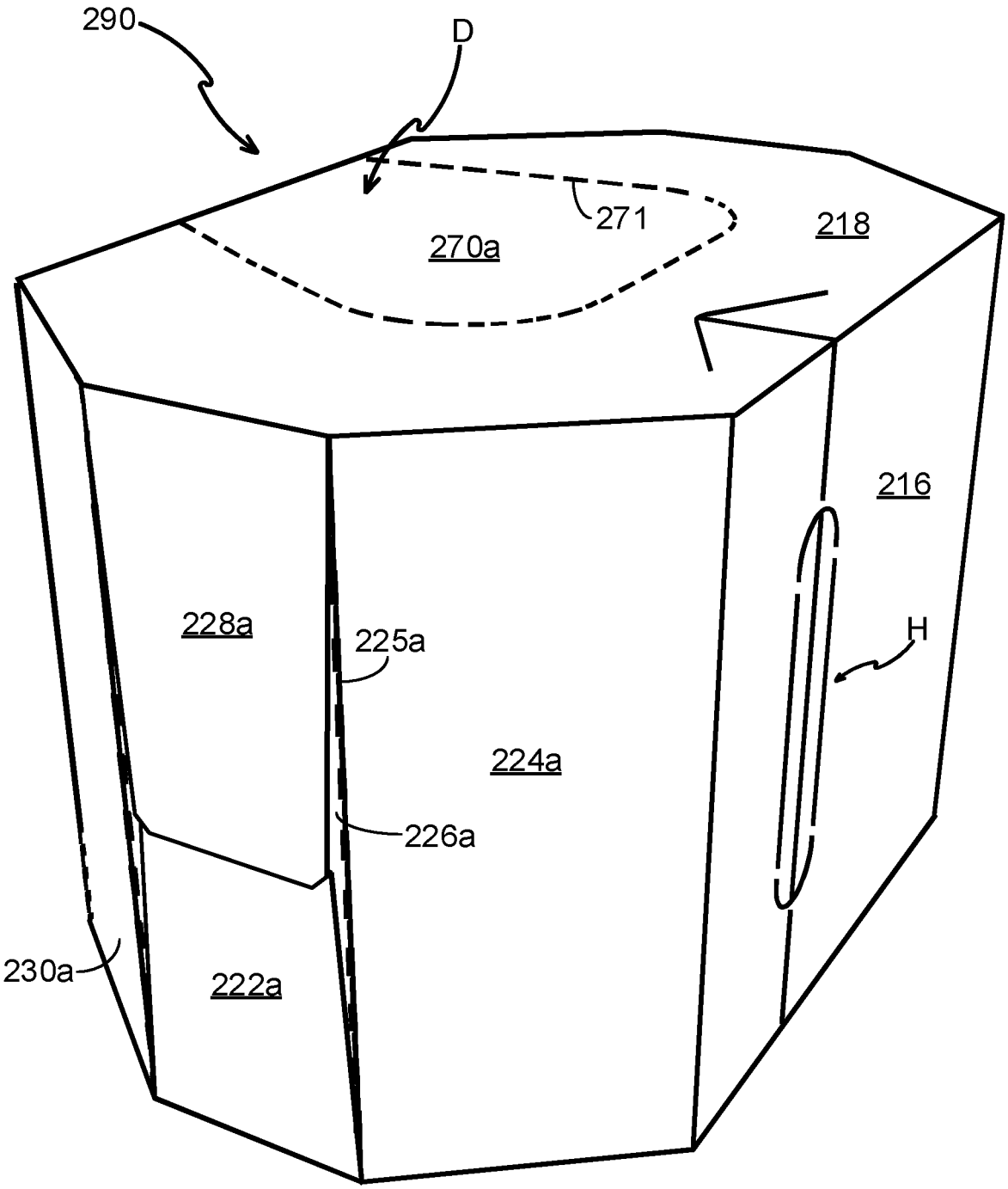
FIG. 10 is a perspective view of an article carrier formed from the blank of FIG. 8.

FIG. 8 shows a plan view of a blank 210, according to yet another embodiment of the disclosure, capable of forming an article carrier or carton 290, as shown in FIG. 10.

Figure 11:
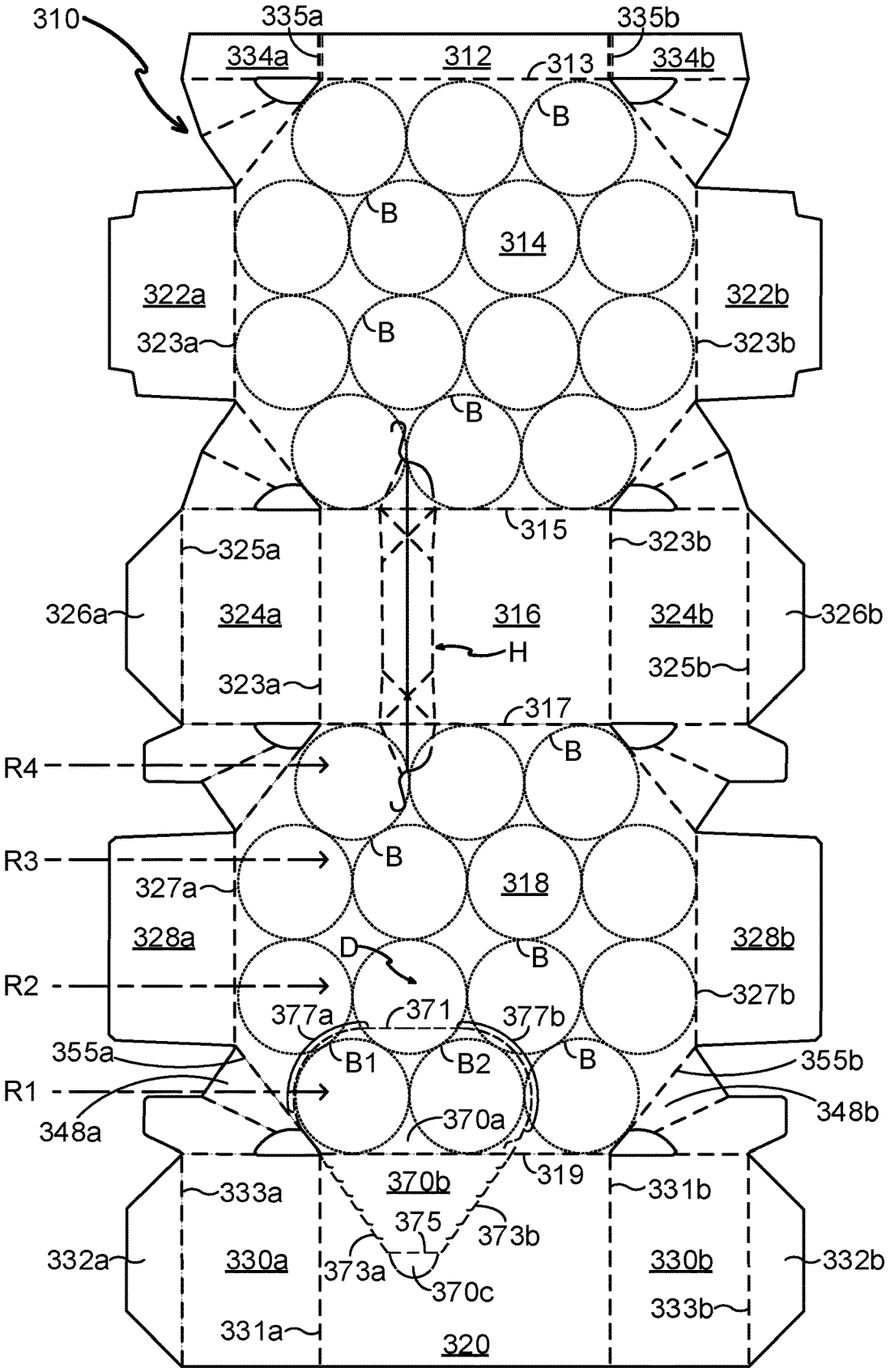
FIG. 11 is a plan view from above of a blank for forming an article carrier according to a fourth embodiment and showing an arrangement of a plurality of articles with respect to top and bottom panels of the blank.
Figure 12:
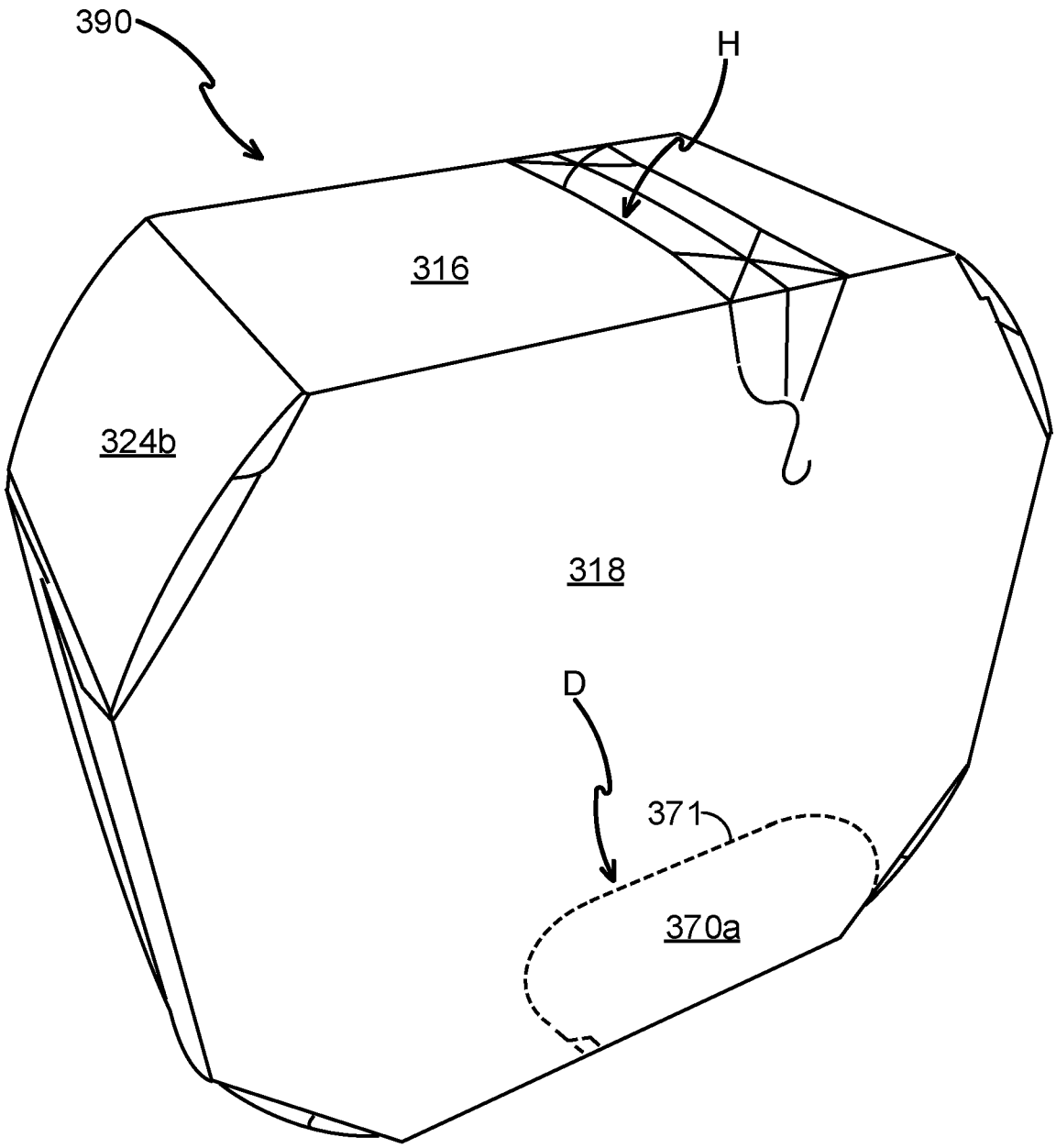
FIG. 12 is a perspective view of an article carrier formed from the blank of FIG. 11.

FIG. 11 shows a plan view of a blank 310, according to still another embodiment of the disclosure, capable of forming an article carrier or carton 390, as shown in FIG. 12.

Figure 13:
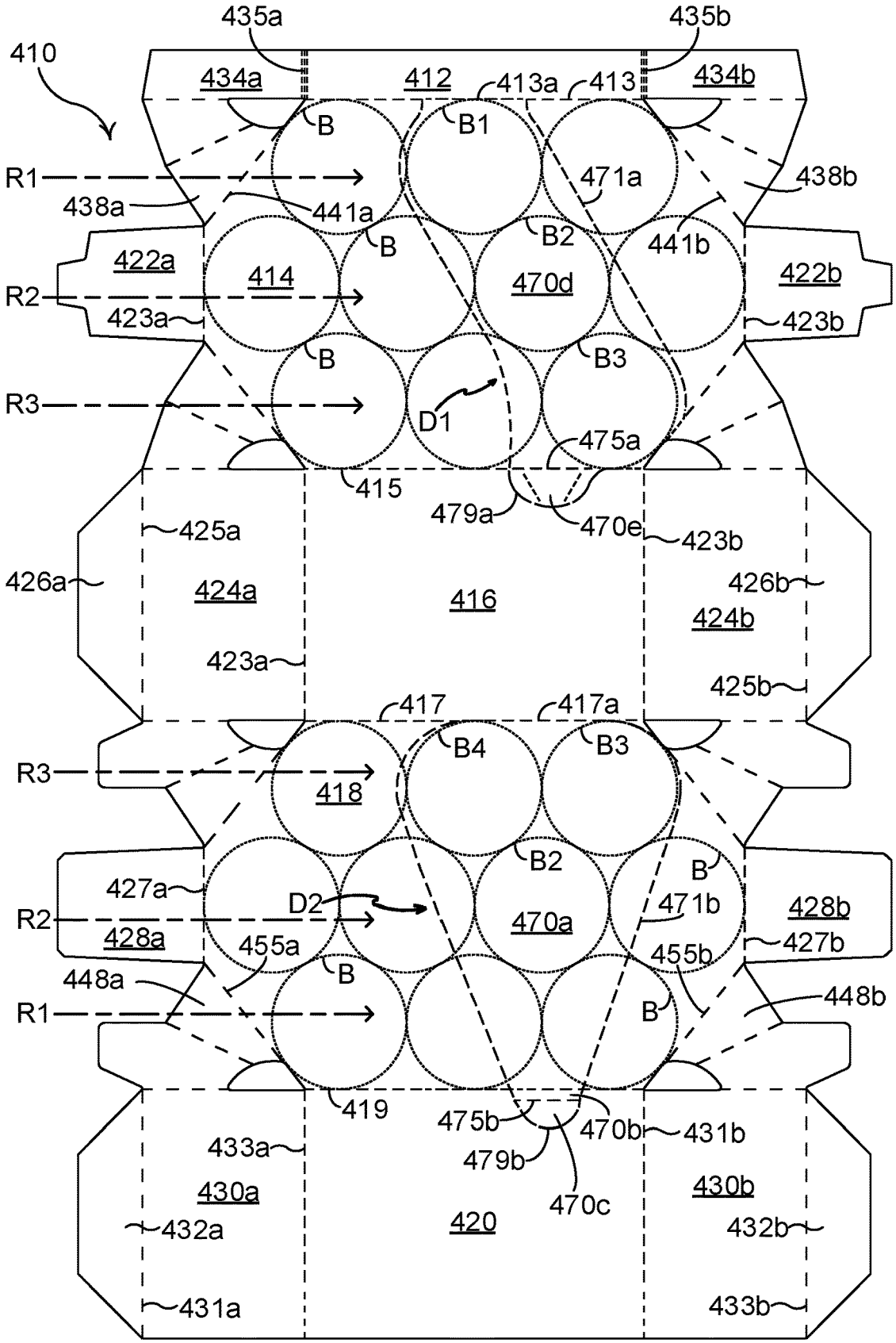
FIG. 13 is a plan view from above of a blank for forming an article carrier according to a fifth embodiment and showing an arrangement of a plurality of articles with respect to top and bottom panels of the blank.
Figure 14:
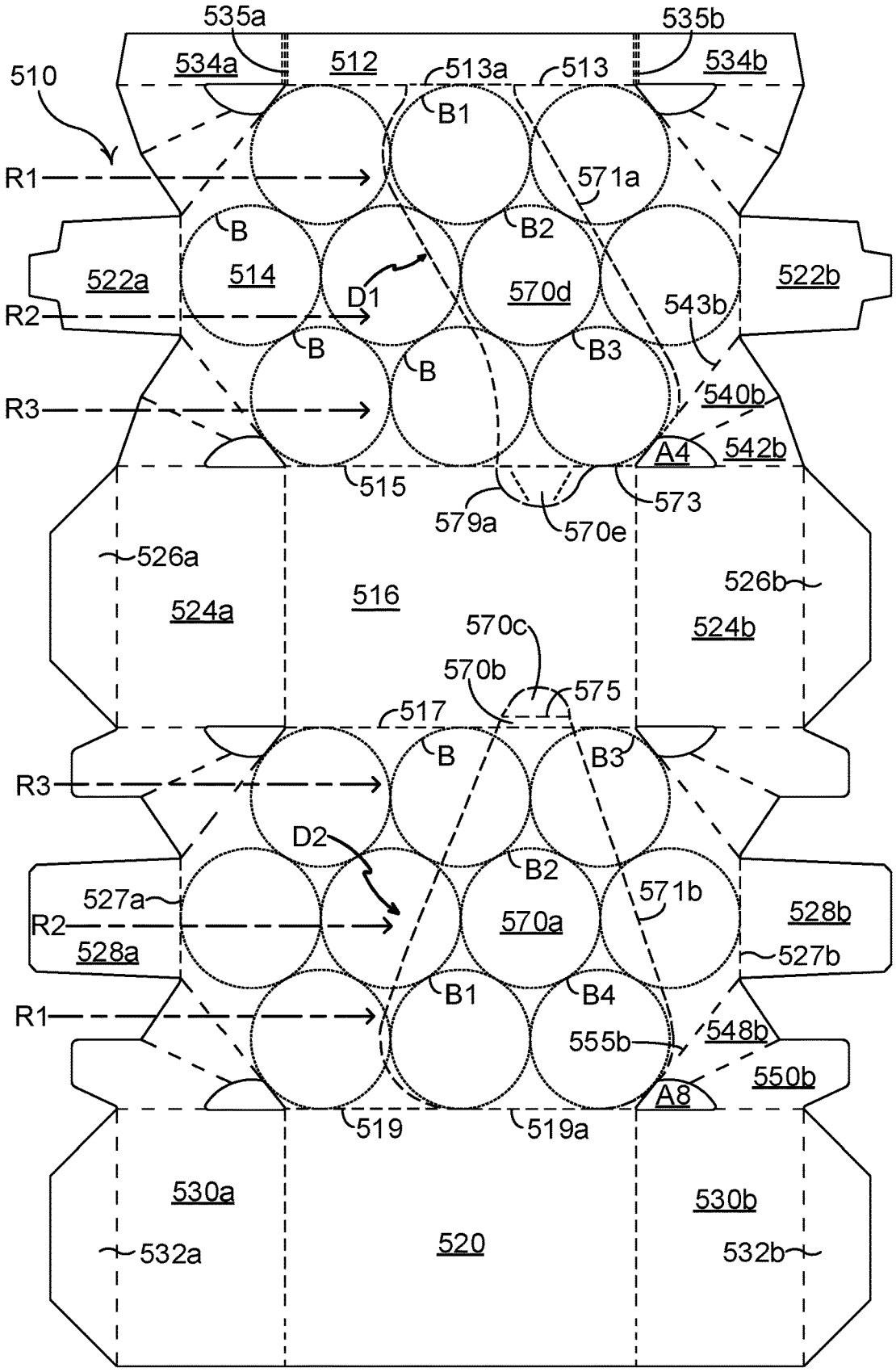
FIG. 14 is a plan view from above of a blank for forming an article carrier according to a sixth embodiment and showing an arrangement of a plurality of articles with respect to top and bottom panels of the blank.
Figure 15:
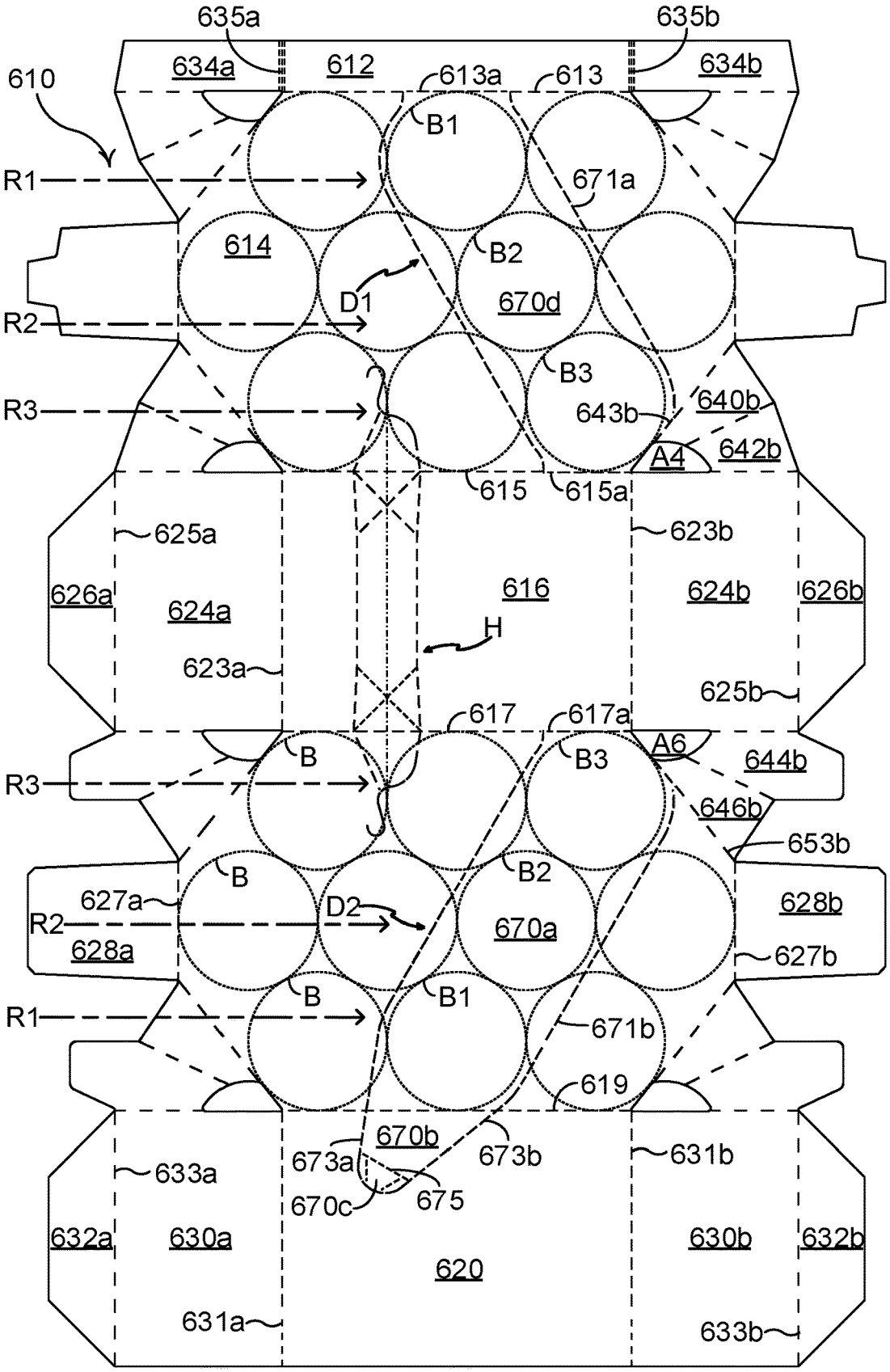
FIG. 15 is a plan view from above of a blank for forming an article carrier according to a seventh embodiment and showing an arrangement of a plurality of articles with respect to top and bottom panels of the blank.

FIGS. 13, 14 and 15 show plan views of blanks 410, 510, 610 according to further embodiments of the disclosure, capable of forming an article carrier or carton (not shown).

In the embodiments detailed herein, the terms "carton" and "carrier" refer, for the non-limiting purpose of illustrating the various features of the invention, to a container 90, 190, 290, 390 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blanks 10, 110, 210, 310, 410, 510, 610 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The cartons 90, 190, 290, 390 described and/or illustrated herein may be formed from a sheet material such as paperboard, which may be made of, or coated with, materials to increase strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or otherwise be prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

In the embodiments illustrated in FIGS. 1 to 10 and FIGS. 13 to 15, the blanks 10; 110; 210; 410; 510; 610 are configured to form a carton or carrier 90; 190; 290 for packaging an exemplary arrangement of exemplary articles B. In the illustrated embodiment the arrangement is a nested arrangement of articles, having three rows R1, R2, R3, the central row R2 comprises four articles, the outer (upper and lower) rows R3, R1 each comprise three articles. The centres (tubular axes) of the articles in the outer rows R1, R3 are offset with respect to the centres (tubular axes) of the articles in the centre row R2. The centre (tubular axes) of an article in one of the outer rows R1, R3 may be substantially aligned with the centre (tubular axes) of an article in the other one of the outer rows R1, R3; the centres of said articles define a notional line. The notional line is disposed tangentially to each of a pair of articles in the centre row R2. Each of the aforesaid articles in the outer rows R1, R3 may be in touching contact with each of the pair of articles in the centre row R2; the pair of articles in the centre row R2 may be in touching contact with each other. The articles B are cans, the illustrated example comprises 12 US fl. oz. (355 ml) beverage cans, the cans may be formed from a suitable material such as, but not limited to, Aluminium. Alternatively, the blanks 10; 110; 210; 410; 510; 610 can be configured to form a carrier for packaging other types, number and size of articles B and/or for packaging articles B in a different arrangement or configuration for example, but not limited to, the articles B may be bottles, cups, pouches or pots.

In the embodiment illustrated in FIGS. 11 and 12, the blank 310 is configured to form a carton or carrier 390 for packaging an exemplary arrangement of exemplary articles B. In the illustrated embodiment the arrangement comprises four rows R1, R2, R3, R4. The outermost (upper and lower) rows R4, R1 each comprise three articles, the inner rows R2, R3 each comprise four articles, best shown in FIG. 11. The centres (tubular axes) of the articles in the outer rows R1, R4 are offset with respect to the centres (tubular axes) of the articles in the adjacent inner row R2, R3. In this way an article in an outer row R1, R4 may be nested between a pair of articles in the adjacent inner row R2, R3, that is to say located in a void between said pair of articles.

The centre (tubular axes) of an article in one of the inner rows R2, R3 may be substantially aligned, so as to be in vertical registry in normal dispensing use, with the centre (tubular axes) of an article in the other one of the inner rows R2, R3.

The centre (tubular axes) of an article in one of the outer rows R1, R4 may be substantially aligned with the centre (tubular axes) of an article in the other one of the outer rows R1, R4. The centres of said articles define a notional line. The notional line is disposed tangentially to each of a pair of articles in each of the inner rows R2, R3. Each of the aforesaid articles in the outer rows R1, R4 may be in touching contact with each of a pair of articles in the adjacent inner row R2, R3. Each article may be in touching contact with at least one adjacent article.

The articles B are cans, the illustrated example comprises 12 US fl. oz. (355 ml) beverage cans, the cans may be formed from a suitable material such as, but not limited to, Aluminium. Alternatively, the blank 310 can be configured to form a carrier for packaging other types, number and size of articles B and/or for packaging articles B in a different arrangement or configuration for example, but not limited to, the articles B may be bottles, cups, pouches or pots.

Turning to FIG. 1, there is illustrated a blank 10 for forming a carton 90 (see FIGS. 3, 4A, 4B and 4C) according to a first embodiment. The blank 10 comprises a plurality of main or primary panels 12, 14, 16, 18, 20 for forming a tubular structure. The plurality of main panels 12, 14, 16, 18, 20 comprises a securing flap 12, a first side panel 14, a top panel 16, a second side panel 18, and a base panel 20. The plurality of main panels 12, 14, 16, 18, 20 may be hingedly connected to each other, one to the next, in a linear series by a respective one of a plurality of hinged connections in the form of fold lines 13, 15, 17, 19.

Figure 4A:
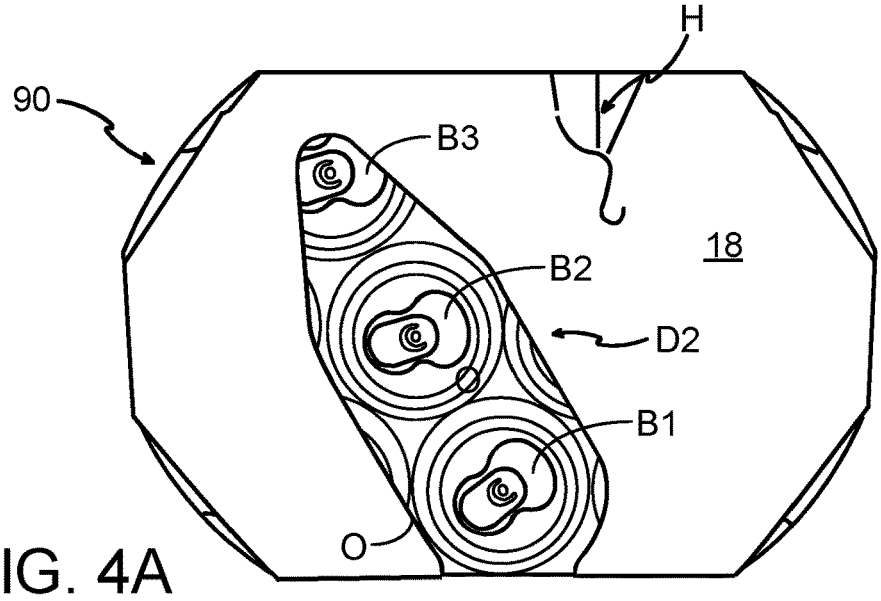
FIGS. 4A to 4C illustrate the article carrier of FIG. 3 in which a dispensing or access feature is in a deployed condition.
Figure 4B:
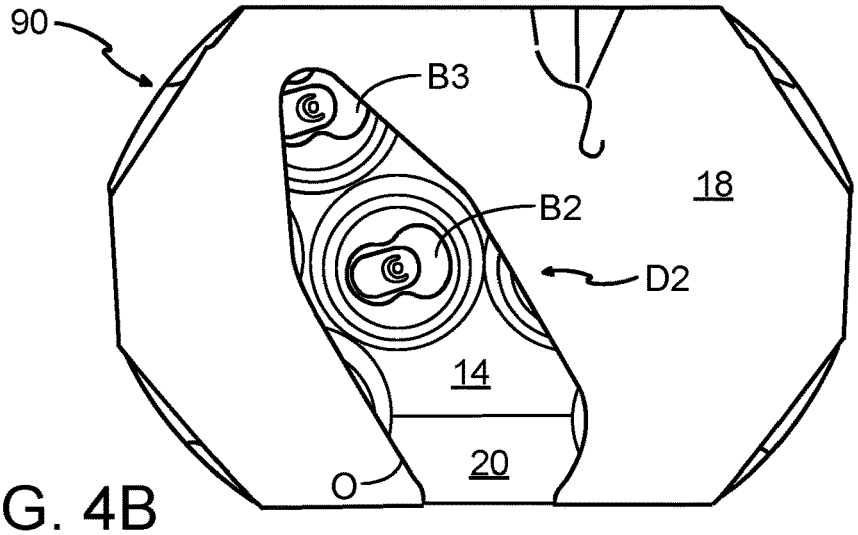
Figure 4C:
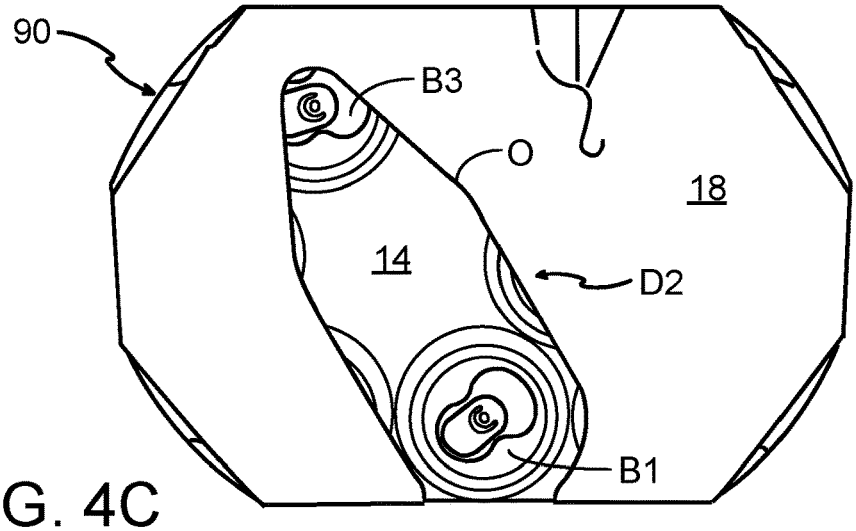

The panels of the blank 10 are described with reference to a dispensing feature D which in use, as shown in FIGS. 4A to 4C, is provided in part in a first panel 18 forming a side wall or side panel of the carton 90 and is provided in part in a second, adjacently disposed, panel 20 forming a base wall or panel of the carton 90. The carton 90 may also comprise a handle structure H, the handle structure H may be provided at least in part in a third panel 16. The third panel 16 may be arranged to oppose the second panel 20. The third panel 16, when the handle structure H is in use, forms a top wall of the carton 90. When the blank 10 is erected to form an open ended tubular structure for loading with articles B, each of the first and second side panels 14, 18 forms one of a top and base wall; in the loading orientation, shown in FIG. 3, the dispensing feature D is in a side wall of the carrier 90.

The first side panel 14 and the second side panel 18 are octagonal in shape. The blank 10 comprises a plurality of major corner or bevel panels 24*a*, 24*b*, 30*a*, 30*b* which partially close ends of the tubular structure defined by plurality of primary panels 12, 14, 16, 18, 20.

The blank 10 comprises a first major corner panel 24*a* hingedly connected to a first end of the top panel 16 by a hinged connection in the form of a fold line 23*a*. The blank 10 comprises a second major corner panel 24*b* hingedly connected to a second end of the top panel 16 by a hinged connection in the form of a fold line 23*b*.

The blank 10 comprises a third major corner panel 30*a* hingedly connected to a first end of the base panel 20 by a hinged connection in the form of a fold line 31*a*. The blank 10 comprises a fourth major corner panel 30*b* hingedly connected to a second end of the base panel 20 by a hinged connection in the form of a fold line 31*b*.

The blank 10 comprises end closure structures for completing closure of the open ends of the tubular structure.

A first end closure structure comprises; a first side end closure panel 22*a* hingedly connected to a first end of the first side panel 14 by a hinged connection in the form of a fold line 21*a*, a second side end closure panel 28*a* hingedly connected to a first end of the second side panel 18 by a hinged connection in the form of a fold line 27*a*, a first top end closure panel 26*a* hingedly connected to the first major corner panel 24*a* by a hinged connection in the form of a fold line 25*a*, and a first base end closure panel 32*a* hingedly connected to the third major corner panel 30*a* by a hinged connection in the form of a fold line 33*a*.

A second end closure structure comprises; a third side end closure panel 22*b* hingedly connected to a second end of the first side panel 14 by a hinged connection in the form of a fold line 21*b*, a fourth side end closure panel 28*b* hingedly connected to a second end of the second side panel 18 by a hinged connection in the form of a fold line 27*b*, a second top end closure panel 26*b* hingedly connected to the second major corner panel 24*b* by a hinged connection in the form of a fold line 25*b*, and a second base end closure panel 32*b* hingedly connected to the fourth major corner panel 30*b* by a hinged connection in the form of a fold line 33*b*.

A first securing tab 34*a* is hingedly connected to a first end of the securing flap 12 by a hinged connection in the form of a fold line 35*a*. A second securing tab 34*b* is hingedly connected to a second end of the securing flap 12 by a hinged connection in the form of a fold line 35*b*.

The first securing tab 34*a* is hingedly connected to the first side panel 14 by a first pair of web panels 36*a*, 38*a*, also referred to herein as minor corner panels. The first pair of web panels 36*a*, 38*a* is hinged to a first beveled or chamfered corner of the first side panel 14. The first pair of web panels 36*a*, 38*a* underlies the third major corner panel 30*a* in a setup condition. A first web panel 36*a* is hingedly connected to the first securing tab 34*a* by a hinged connection in the form of a fold line 37*a*. A second web panel 38*a* is hingedly connected to the first web panel 36*a* by a hinged connection in the form of a fold line 39*a*. The second web panel 38*a* is hingedly connected to the first side panel 14 by a hinged connection in the form of a fold line 39*a*.

The fold line 37*a* is substantially collinear with the fold line 13.

Each of the first pair of web panels 36*a*, 38*a* is defined in part by a pair of divergently arranged fold lines 37*a*/39*a*, 39*a*/41*a*.

The blank 10 comprises a first aperture A1 struck from the first pair of web panels 36*a*, 38*a* so as to interrupt the fold lines 37*a*, 39*a*, 41*a*. The first aperture A1 is located at a position at which the fold lines 37*a*, 39*a*, 41*a* would intersect with each other and with the fold lines 13 and 35*a*.

The second securing tab 34*b* is hingedly connected to the first side panel 14 by a second pair of web panels 36*b*, 38*b*, also referred to herein as minor corner panels. The second pair of web panels 36*b*, 38*b* is hinged to a second beveled or chamfered corner of the first side panel 14. The second pair of web panels 36*b*, 38*b* underlies the fourth major corner panel 30*b* in a setup condition. A third web panel 36*b* is hingedly connected to the second securing tab 34*b* by a hinged connection in the form of a fold line 37*b*. A fourth web panel 38*b* is hingedly connected to the third web panel 36*b* by a hinged connection in the form of a fold line 39*b*. The fourth web panel 38*b* is hingedly connected to the first side panel 14 by a hinged connection in the form of a fold line 39*b*.

The fold line 37*b* is substantially collinear with the fold line 13.

Each of the second pair of web panels 36*b*, 38*b* is defined in part by a pair of divergently arranged fold lines 37*b*/39*b*, 39*b*/41*b*.

The blank 10 comprises a second aperture A2 struck from the second pair of web panels 36*b*, 38*b* so as to interrupt the fold lines 37*b*, 39*b*, 41*b*. The second aperture A2 is located at a position at which the fold lines 37*b*, 39*b*, 41*b* would intersect with each other and with the fold lines 13 and 35*b*.

The first major corner panel 24*a* is hingedly connected to the first side panel 14 by a third pair of web panels 40*a*, 42*a*, also referred to herein as minor corner panels. The third pair of web panels 40*a*, 42*a* is hinged to a third beveled or chamfered corner of the first side panel 14. The third pair of web panels 40*a*, 42*a* underlies the first major corner panel 24*a* in a setup condition. A fifth web panel 40*a* is hingedly connected to the first side panel 14 by a hinged connection in the form of a fold line 43*a*. A sixth web panel 42*a* is hingedly connected to the fifth web panel 40*a* by a hinged connection in the form of a fold line 45*a*. The sixth web panel 42*a* is hingedly connected to the first major corner panel 24*a* by a hinged connection in the form of a fold line 47*a*.

The fold line 47*a* is substantially collinear with the fold line 15.

Each of the third pair of web panels 40*a*, 42*a* is defined in part by a pair of divergently arranged fold lines 43*a*/45*a*, 45*a*/47*a*.

The blank 10 comprises a third aperture A3 struck from the third pair of web panels 40*a*, 42*a* so as to interrupt the fold lines 43*a*, 45*a*, 47*a*. The third aperture A3 is located at a position at which the fold lines 43*a*, 45*a*, 47*a* would intersect with each other and with the fold lines 15 and 23*a*.

The second major corner panel 24*b* is hingedly connected to the first side panel 14 by a fourth pair of web panels 40*b*, 42*b* also referred to herein as minor corner panels. The fourth pair of web panels 40*b*, 42*b* is hinged to a third beveled or chamfered corner of the first side panel 14. The fourth pair of web panels 40*b*, 42*b* underlies the second major corner panel 24*b* in a setup condition. A seventh web panel 40*b* is hingedly connected to the first side panel 14 by a hinged connection in the form of a fold line 43*b*. An eighth web panel 42*b* is hingedly connected to the seventh web panel 40*b* by a hinged connection in the form of a fold line 45*b*. The eighth web panel 42*b* is hingedly connected to the second major corner panel 24*b* by a hinged connection in the form of a fold line 47*b*.

The fold line 47*b* is substantially collinear with the fold line 15.

Each of the fourth pair of web panels 40*b*, 42*b* is defined in part by a pair of divergently arranged fold lines 43*b*/45*b*, 45*b*/47*b*.

The blank 10 comprises a fourth aperture A4 struck from the fourth pair of web panels 40*b*, 42*b* so as to interrupt the fold lines 43*b*, 45*b*, 47*b*. The fourth aperture A4 is located at a position at which the fold lines 43*b*, 45*b*, 47*b* would intersect with each other and with the fold lines 15 and 23*b*.

The first major corner panel 24*a* is hingedly connected to the second side panel 18 by a fifth pair of web panels 44*a*, 46*a*, also referred to herein as minor corner panels. The fifth pair of web panels 44*a*, 46*a* is hinged to a first beveled or chamfered corner of the second side panel 18. The fifth pair of web panels 44*a*, 46*a* underlies the first major corner panel

24*a* in a setup condition. A ninth web panel 44*a* is hingedly connected to the first major corner panel 24*a* by a hinged connection in the form of a fold line 49*a*. A tenth web panel 46*a* is hingedly connected to the ninth web panel 44*a* by a hinged connection in the form of a fold line 51*a*. The tenth web panel 46*a* is hingedly connected to the second side panel 18 by a hinged connection in the form of a fold line 53*a*.

The fold line 49*a* is substantially collinear with the fold line 17.

Each of the fifth pair of web panels 44*a*, 46*a* is defined in part by a pair of divergently arranged fold lines 49*a*/51*a*, 51*a*/53*a*.

The blank 10 comprises a fifth aperture A5 struck from the fifth pair of web panels 44*a*, 46*a* so as to interrupt the fold lines 49*a*, 51*a*, 53*a*. The fifth aperture A5 is located at a position at which the fold lines 49*a*, 51*a*, 53*a* would intersect with each other and with the fold lines 17 and 23*a*.

The second major corner panel 24*b* is hingedly connected to the second side panel 18 by a sixth pair of web panels 44*b*, 46*b*, also referred to herein as minor corner panels. The sixth pair of web panels 44*b*, 46*b* is hinged to a second beveled or chamfered corner of the second side panel 18. The sixth pair of web panels 44*b*, 46*b* underlies the second major corner panel 24*b* in a setup condition. An eleventh web panel 44*b* is hingedly connected to the second major corner panel 24*b* by a hinged connection in the form of a fold line 49*b*. A twelfth web panel 46*b* is hingedly connected to the eleventh web panel 44*b* by a hinged connection in the form of a fold line 51*b*. The twelfth web panel 46*b* is hingedly connected to the second side panel 18 by a hinged connection in the form of a fold line 53*b*.

The fold line 49*b* is substantially collinear with the fold line 17.

Each of the sixth pair of web panels 44*b*, 46*b* is defined in part by a pair of divergently arranged fold lines 49*b*/51*b*, 51*b*/53*b*.

The blank 10 comprises a sixth aperture A6 struck from the sixth pair of web panels 44*b*, 46*b* so as to interrupt the fold lines 49*b*, 51*b*, 53*b*. The sixth aperture A6 is located at a position at which the fold lines 49*b*, 51*b*, 53*b* would intersect with each other and with the fold lines 17 and 23*b*.

The third major corner panel 30*a* is hingedly connected to the second side panel 18 by a seventh pair of web panels 48*a*, 50*a*, also referred to herein as minor corner panels. The seventh pair of web panels 48*a*, 50*a* is hinged to a third beveled or chamfered corner of the second side panel 18. The seventh pair of web panels 48*a*, 50*a* underlies the third major corner panel 30*a* in a setup condition. A thirteenth web panel 48*a* is hingedly connected to the second side panel 18 by a hinged connection in the form of a fold line 55*a*. A fourteenth web panel 50*a* is hingedly connected to the thirteenth web panel 48*a* by a hinged connection in the form of a fold line 57*a*. The fourteenth web panel 50*a* is hingedly connected to the third major corner panel 30*a* by a hinged connection in the form of a fold line 59*a*.

The fold line 59*a* is substantially collinear with the fold line 19.

Each of the seventh pair of web panels 48*a*, 50*a* is defined in part by a pair of divergently arranged fold lines 55*a*/57*a*, 57*a*/59*a*.

The blank 10 comprises a seventh aperture A7 struck from the seventh pair of web panels 48*a*, 50*a* so as to interrupt the fold lines 55*a*, 57*a*, 59*a*. The seventh aperture A7 is located at a position at which the fold lines 55*a*, 57*a*, 59*a* would intersect with each other and with the fold lines 19 and 31*a*.

The fourth major corner panel 30*b* is hingedly connected to the second side panel 18 by an eighth pair of web panels 48*b*, 50*b*, also referred to herein as minor corner panels. The eighth pair of web panels 48*b*, 50*b* is hinged to a fourth beveled or chamfered corner of the second side panel 18. The eighth pair of web panels 48*b*, 50*b* underlies the fourth major corner panel 30*b* in a setup condition. A fifteenth web panel 48*b* is hingedly connected to the second side panel 18 by a hinged connection in the form of a fold line 55*b*. A sixteenth web panel 50*b* is hingedly connected to the fifteenth web panel 48*b* by a hinged connection in the form of a fold line 57*b*. The sixteenth web panel 50*b* is hingedly connected to the fourth major corner panel 30*b* by a hinged connection in the form of a fold line 59*b*.

The fold line 59*b* is substantially collinear with the fold line 19.

Each of the eighth pair of web panels 48*b*, 50*b* is defined in part by a pair of divergently arranged fold lines 55*b*/57*b*, 57*b*/59*b*.

The blank 10 comprises an eighth aperture A8 struck from the eighth pair of web panels 48*b*, 50*b* so as to interrupt the fold lines 55*b*, 57*b*, 59*b*. The eighth aperture A8 is located at a position at which the fold lines 55*b*, 57*b*, 59*b* would intersect with each other and with the fold lines 19 and 31*b*.

The blank 10 may comprise a handle structure H. The blank 10 may comprise a handle structure H. The handle structure H may be provided at least in part in the top panel 16. The handle structure H comprises a handle opening or slot defined in the top panel 16. The handle opening may be defined at least in part by a first handle tab 60*a*. The first handle tab 60*a* is struck from the top panel 16 and is hingedly connected thereto by a hinged connection in the form of a fold line 61*a*. The handle opening may be defined at least in part by a second handle tab 60*b*. The second handle tab 60*b* is struck from the top panel 16 and is hingedly connected thereto by a hinged connection in the form of a fold line 61*b*. The second handle tab 60*b* is hinged in opposition to the first handle tab 60*a*. The second handle tab 60*b* is separate from, or severable from the first handle tab 60*a* by a common cut line or severance line 69.

A line of separation 69 defines the centre of the slot-type carrying handle H. The line of separation 69 is spaced a longitudinal distance from first and second ends of the top panel 16 (defined by fold lines 23*a*, 23*b* respectively). The line of separation 69 is located so as to be disposed off-centre with respect to the first and second ends of the top panel 16. Optionally, in other embodiments, the slot-type carrying handle H may be disposed in an at least substantially central position. The line of separation 69 is positioned such that when the blank 10 is formed into a carton 90 the line of separation 69 is located above a gap or void between two adjacent articles B.

The line of separation 69 extends into each of the adjacent first and second side panels 14, 18. In other embodiments, the slot-type carrying handle H may extend into only one of the adjacent first and second side panels 14, 18. The line of separation 69 is optionally a perforate cut line comprising one or more or a series of connecting nick portions. Optionally six connecting nick portions are provided in the top panel 16 along the line of separation 69; one nick portion is provided along the portion of the line of the separation 69 in the first side panel 14; one nick portion is provided along the portion of the line of the line of separation 69 in the second side panel 18.

Spaced either side of the line of separation 69 and within the top panel 16 a pair of fold lines 61*a*, 61*a* define each of the lifting edges of the slot-type carrying handle H. Between fold line 61*a* and line of separation 69 a cushioning flap 60*a* is formed, likewise, between fold line 61*a* and line of separation 69 a cushioning flap 60*b* is formed. The width of the cushioning flaps may be controlled such that when folded beneath the plane of the top panel 16, the cushioning flaps can fold within the gap between the top panel 16 and two adjacently located articles B and at least partially underneath the top panel 16.

At each end of each cushioning flap 60*a*, 60*b* pairs of gussets are formed by crossed fold lines. Optionally the fold lines are disposed at least substantially at 90° relative to one another.

At each end of the slot-type carrying handle H a stress relief mechanism is provided which is tailored and configured to mitigate against stress build up or localised stress points in the carton 90 when the carton 90 is carried by the slot-type carrying handle H, in either direction (i.e. by using edge 61*a* or 61*b*).

The stress relief mechanisms (also referred to as relief cuts) are identical and therefore only one will be described, it being understood that the details provided regarding one end of the slot-type carrying handle H are also true in respect of the other end of the slot-type carrying handle H.

An optional curvilinear crease-cut line 65*b* extends from the intersection of fold lines 61*b* and 17. The curvilinear crease-cut line 65*b* may be formed as a crease along a first linear aspect and then optionally a full-depth cut line on a second curved aspect. The cut line portion of crease-cut line 65*b* may extend beyond the termination of line of separation 69 and in close proximity thereto. The cut line portion of crease-cut line 65*b* may terminate with a substantially "J"-shaped or hook-shaped cut line 67*b*. The cut line portion of crease-cut line 65*b* and the line of separation 69 define a first foldable tab 64*b*.

A linear crease line 65*a* extends from the cut line portion of crease-cut line 65*b* back toward the intersection between fold line 61*a* and fold line 17, to define a second foldable tab 64*a*.

The blank 10 comprises at least one access device or dispenser D1, D2 for gaining access to an interior of the carton 90 so as to be able to remove the carton contents. The illustrated embodiment comprises two access devices D1, D2. A first access device D1 is defined in the first side panel 14. A second access device D2 is defined in the second side panel 18. Each of the access device D1, D2 is substantially the same in construction and will be described in further detail by reference to the second access device D2.

The second access device D2 comprises a removable or detachable panel 70*a*.

The detachable panel 70*a* is struck from the second side panel 18. The detachable panel 70*a* extends from the fold line 19 hinging the second side panel 18 to the base panel 20. The detachable panel 70*a* may be considered to interrupt the fold line 19.

The detachable panel 70*a* is defined in part by a first severance line or tear line 71 provided in the second side panel 18. The detachable panel 70*a* is defined in part by a second severance line or tear line 19*a*. The second severance line 19*a* is collinear and/or coextensive with the fold line 19. The second severance line 19*a* may be considered to interrupt the fold line 19.

The second dispenser D2 comprises an opening having a maximum length $L_1$ extending along the second side panel or wall 18. The maximum length $L_1$ may be equal to or greater than twice the maximum diameter of each article B of the group.

The opening has a width $W_1$ extending perpendicularly to the maximum length $L_1$ along the side second side panel 18. The width $W_1$ may be equal to or greater than the maximum diameter.

The second access device D2 comprises a tear initiator 70*c*. The tear initiator 70*c* is struck from, or defined in, the second side panel 18. The tear initiator 70*c* comprises a tab 70*c* hingedly connected to the detachable panel 70*a* by a hinged connection in the form of a fold line 75.

The tab 70*c* may be positioned such that when the blank 10 is formed into a carton 90 the tab 70*c* is located adjacent a gap or void between the second side wall 18 and an adjacent article B3 (see FIG. 4A). An end of the article B3 may be concave or recessed so as to provide said void. The article B3 is disposed in an uppermost row R3 of the group of articles B. Alternatively, the tab 70*c* may be located adjacent a gap or void between two or more articles.

The first tear line 71 comprises a first linear portion and a second linear portion defining opposing side edges of the detachable or removable panel 70*a*. The first linear portion may be generally parallel to the second linear portion.

The first linear portion of the first tear line 71 is located closer to a first corner edge 55*a* of the second side panel 18 than the second linear portion of the first tear line 71. The first corner edge 55*a* of the second side panel 18 is defined by fold line 55*a* which hinges the thirteenth web panel 48*a* to the second side panel 18.

The first corner edge 55*a* extends obliquely with respect to the fold line 19 hinging the base panel 20 to the second side panel 18. An obtuse angle is defined between the first corner edge 55*a* and the fold line 19 between the base panel 20 and the second side panel 18.

A second corner edge 55*b* of the second side panel 18 is defined by fold line 55*b* which hinges the fifteenth web panel 48*b* to the second side panel 18. The second linear portion of the first tear line 71 is located closer to the second corner edge 55*b* of the second side panel 18 than the first linear portion of the first tear line 71.

The second corner edge 55*b* extends obliquely with respect to the fold line 19 hinging the base panel 20 to the second side panel 18. An obtuse angle is defined between the second corner edge 55*b* and the fold line 19 between the base panel 20 and the second side panel 18.

Turning to the construction of the package as illustrated in FIGS. 3 to 4C, the article carrier 90 can be formed by a series of sequential folding operations. The folding process is not limited to that described below and may be altered according to particular manufacturing requirements.

The blank 10 is folded about fold line 15 such that the first side panel 14 is brought into overlying relationship with the top panel 16 and with part of the second side panel 18, and such that the securing flap 12 is brought into overlying relationship with the second side panel 18.

Glue or other adhesive treatment is applied to the securing flap 12 and to the first and second securing tabs 34*a*, 34*b*. In other embodiments the glue may be applied to corresponding regions of an inner surface of the base panel 20 and the third and fourth corner panels 30*a*, 30*b*.

The blank 10 is folded about fold line 19 such that the base panel 20 is brought into overlying relationship with the second side panel 18 and into face contacting relationship with the securing flap 12. A portion of each of the third and fourth corner panels 30*a*, 30*b* is brought into overlying relationship with the second side panel 18, the third and fourth corner panels 30*a*, 30*b* are brought into face contacting relationship with a respective one of the first and second securing tabs 34*a*, 34*b*.

The base panel 20 is secured to the securing flap 12. The third major corner panel 30*a* is secured to the first securing tab 34*a*. The fourth corner panel 30*b* is secured to the second securing tab 34*b*.

In this way the blank 10 is formed into a flat collapsed tubular structure which can be readily shipped or distributed to a convertor plant, at which the flat collapsed tubular structure may be erected into an open ended tubular structure and loaded with articles.

The flat collapsed tubular structure may be erected to form an open ended tubular structure by unfolding the top panel 16 with respect to the first side panel 14 such that the top panel 16 is disposed substantially perpendicularly with respect to the first side panel 14.

The carton 90, in its open ended tubular form, may be loaded with articles through one or both open ends thereof. It will be appreciated that in some embodiments one of the open ends of the carton 90 may be closed before loading the interior with articles through the remaining open end.

A first end of the tubular structure is closed by folding the first major corner panel 24*a*, about fold line 23*a*, with respect to the top panel 16. The fifth and sixth web panels 40*a*, 42*a* are folded internally into face to face relationship with each other. The ninth and tenth web panels 44*a*, 46*a* are folded internally into face to face relationship with each other.

The third major corner panel 30*a* is folded with respect to the base panel 20, about fold line 31*a*. The first securing tab 34*a* is folded, with respect to the securing flap 12, about fold line 35*a*. The thirteenth and fourteenth web panels 48*a*, 50*a* are folded internally into face to face relationship with each other. The first and second web panels 36*a*, 38*a* are folded internally into face to face relationship with each other.

The first top end closure panel 26*a* is folded with respect to the first major corner panel 24*a*, about fold line 25*a*. The first base end closure panel 32*a* is folded with respect to the third major corner panel 30*a*, about fold line 33*a*.

The first side end closure flap 22*a* is folded with respect to the first side panel 14, about fold line 21*a*.

Glue or other adhesive treatment is applied to the first side end closure flap 22*a*. In other embodiments the glue may be applied to a corresponding region of an inner surface of the second side end closure flap 28*a*.

The second side end closure flap 28*a* is folded with respect to the second side panel 18, about fold line 27*a*.

The second side end closure flap 28*a* is brought into overlapping relationship with the first side end closure flap 22*a*. The second side end closure flap 28*a* is brought into face to face contacting relationship with the first side end closure flap 22*a*. The second side end closure flap 28*a* is secured to the first side end closure flap 22*a*.

A second end of the tubular structure is closed by folding the second major corner panel 24*b*, about fold line 23*b*, with respect to the top panel 16. The seventh and eighth web panels 40*b*, 42*b* are folded internally into face to face relationship with each other. The eleventh and twelfth web panels 44*b*, 46*b* are folded internally into face to face relationship with each other.

The fourth major corner panel 30*b* is folded with respect to the base panel 20, about fold line 31*b*. The second securing tab 34*b* is folded with respect to the securing flap 12, about fold line 35*b*. The fifteenth and sixteenth web panels 48*b*, 50*b* are folded internally into face to face relationship with each other. The third and fourth web panels 36*b*, 38*b* are folded internally into face to face relationship with each other.

The second top end closure panel 26*b* is folded with respect to the second major corner panel 24*b*, about fold line 25*b*. The second base end closure panel 32*b* is folded with respect to the fourth major corner panel 30*b*, about fold line 33*b*.

The third side end closure flap 22*b* is folded with respect to the first side panel 14, about fold line 21*b*.

Glue or other adhesive treatment is applied to the third side end closure flap 22*b*. In other embodiments the glue may be applied to a corresponding region of an inner surface of the fourth side end closure flap 28*b*.

The fourth side end closure flap 28*b* is folded with respect to the second side panel 18, about fold line 27*b*.

The fourth side end closure flap 28*b* is brought into overlapping relationship with the third side end closure flap 22*b*. The fourth side end closure flap 28*b* is brought into face to face contacting relationship with the third side end closure flap 22*b*. The fourth side end closure flap 28*b* is secured to the third side end closure flap 22*b*.

FIG. 3 shows an assembled article carrier 90. The article carrier comprises a tubular structure defined by the plurality of main or primary panels 12, 14, 16, 18, 20.

FIGS. 4A to 4C show the article carrier 90 with the dispenser D in a deployed condition, the detachable panel 70*a* has been removed to provide an opening through which the carrier's contents can be removed. When the detachable panel 70*a* is removed a plurality of articles B are exposed to view.

When the detachable panel 70*a* and the tear initiator 70*c* are removed an opening O is formed in the second side wall 18, see FIG. 4A. A first article B1 in the lowermost row R1 (also referred to as a first row R1) is fully exposed to view, the first article B1 may be centrally located within the lowermost row R1.

Each of the articles B in the lowermost row R1 disposed adjacent to the, fully exposed, first article B1 are partially exposed to view, one or both of said partially exposed articles B may be endmost articles of the lowermost row R1.

A second article B2 in a row adjacent to the lowermost row R1, the central row R2 (also referred to as a second row R2), is fully exposed to view, the second article B2 may be in touching contact with the first article B1 in the lowermost row R1 and with one of the articles B in the lowermost row R1 disposed adjacent to the first article B1.

A third article B3 in a row adjacent to the central row R2, the uppermost row R3 (also referred to as a third row R3) is partially exposed to view, the third article B3 may be in touching contact with the second article B2 in the central row R2 and with one of the articles B in the central row R2 disposed adjacent to the second article B2.

Removal of the first article B1 from the carton 90, as shown in FIG. 4B, will not affect the position of the remaining articles B, due to the nested arrangement the other articles will be held or stay in their initial position.

Removal of the second article B2 without removing the first article B1 from the carton 90, as shown in FIG. 4C, will not affect the position of the remaining articles B, due to the nested arrangement the other articles will be held or stay in their initial position.

Removal of the first and second articles B1, B2 will release the group of articles within the carton 90 such that the remaining articles in the carton 90 cascade generally downward, towards the base panel 20. This movement of the articles B will allow removal of further articles B through the opening O in the second side wall 18 created by removal of the detachable panel 70*a* and the tear initiator 70*c*.

It will be appreciated that the detachable panels 70*a* of both of the first and second access devices D1, D2 may be removed such that opposed ends of the first and second articles B1, B2 are fully exposed to view. A user may then push one end of the first and second articles B1, B2 such that it protrudes or passes through the opening in the side wall 14, 18 opposing that from which it was engaged.

Figure 6:
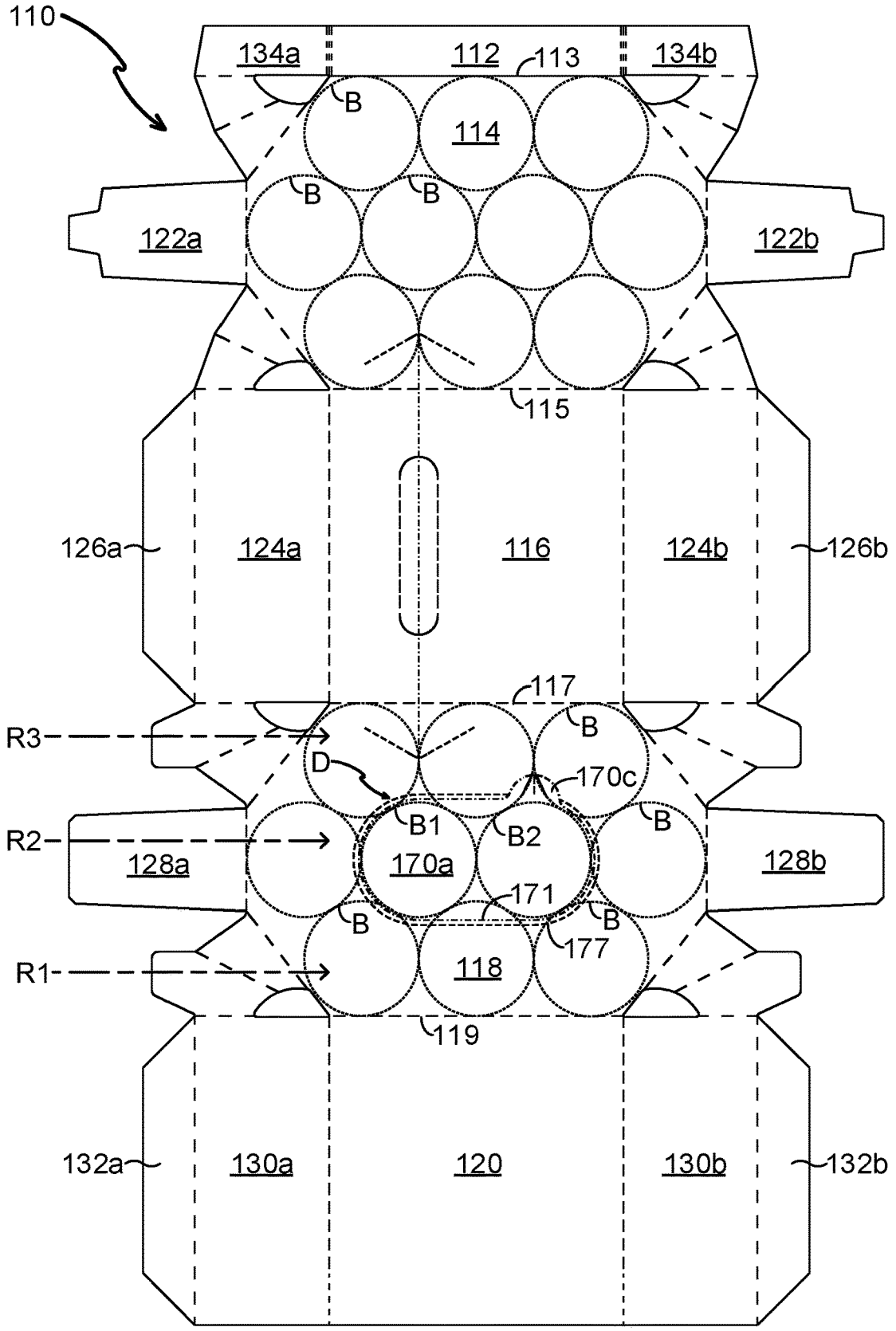
FIG. 6 is a plan view from above of the blank of FIG. 5 showing an arrangement of a plurality of articles with respect to top and bottom panels of the blank.

Referring now to FIGS. 5 to 7 there is shown an alternative embodiment of the present disclosure. In the second illustrated embodiment, like numerals have, where possible, been used to denote like parts, albeit with the addition of the prefix "100" to indicate that these features belong to the second embodiment. The second embodiment shares many common features with the embodiment of FIGS. 1 to 4C, therefore only the differences from the embodiment illustrated in FIGS. 1 to 4C will be described in any greater detail.

FIG. 5 shows a blank 110 for forming an article carrier or carton 190 (see FIG. 7) according to a second embodiment. The blank 110 comprises a plurality of primary panels 112, 114, 116, 118, 120 for forming a tubular structure. The plurality of main panels 112, 114, 116, 118, 120 comprises a securing flap 112, a first side panel 114, a top panel 116, a second side panel 118, and a base panel 120. The plurality of main panels 112, 114, 116, 118, 120 may be hingedly connected to each other, one to the next, in a linear series by a respective one of a plurality of hinged connections in the form of fold lines 113, 115, 117, 119.

The blank 110 may comprise a handle structure H. The handle structure H may be provided at least in part in the top panel 116. The handle structure H comprises a handle opening or slot defined in the top panel 116. The handle opening may be defined at least in part by a first handle tab 160*a*. The first handle tab 160*a* is struck from the top panel 116 and is hingedly connected thereto by a hinged connection in the form of a fold line 161*a*. The handle opening may be defined at least in part by a second handle tab 160*b*. The second handle tab 160*b* is struck from the top panel 116 and is hingedly connected thereto by a hinged connection in the form of a fold line 161*b*. The second handle tab 160*b* is hinged in opposition to the first handle tab 160*a*. The second handle tab 160*b* is separated from, or severable from, the first handle tab 160*a* by a common cut line or severance line 163.

The handle structure H may extend into the adjacent panels, for example into the first side panel 114 and the second side panel 118. The severance line 163 may extend into each of the base and top panels 114, 118, a first severance line extension 163*a* may be provided in the first side panel 114. A second severance line extension 163*b* may be provided in the second side panel 118. The handle structure H comprises a relief structure, the relief structure may redirect or distribute load forces in the handle structure through the carton and or onto the contents (articles B) in the carton.

The relief structure comprises a cutline extending from the end of the first and second severance line extensions 163*a*, 163*b*. Each cutline is divergently arranged with respect to the first and second severance line extensions 163*a*, 163*b* from which it extends. The cut line may be 'V' or 'U' shaped. Each cut line is arranged so as to converge at the end of the first and second severance line extension 163*a*, 163*b*. The cutline and the respective first or second severance line extension 163*a*, 163*b* diverges from the respective first or second severance line extensions 163*a*, 163*b* towards the top panel 116.

The first side panel 114 comprises a pair of divergently arranged fold lines 165*a*, 165*b*, extending from the cutline towards the top panel 116. The top panel 116 comprises a pair of divergently arranged fold lines 167*a*, 167*b*, extending from the cutline towards the top panel 116.

The blank 110 comprises an access device or dispenser D for gaining access to an interior of the carton 190 so as to be able to remove the carton contents.

The dispenser D comprises a detachable panel 170*a*.

The detachable panel 170*a* is struck from, or defined within, the second side panel 118.

The detachable panel 170*a* is defined by a first severance line or tear line 171 provided in the second side panel 118.

The dispenser D comprises a tear initiator 170*c* comprising a tab 170*c* integrally or continuously formed with the detachable panel 170*a*. The tab 170*c* is defined in part by a portion of tear line 171, the portion of tear line 171 may be 'U' shaped or semi-circular outline, although in other embodiments other shapes may be employed.

The tab 170*c* may be positioned such that when the blank 110 is formed into a carton 190 the tab 70*c* is located adjacent a gap or void between three adjacently disposed articles; for example, but not limited to, the second article B2 and the two articles B in the uppermost row R3 in touching contact with the second article B2.

The detachable panel 170*a* is generally oval or stadium shaped (discorectangle or obround). The tab 170*c* extends outwardly from the perimeter of the discorectangle so as to provide a lobe or projection therefrom.

The detachable panel 170*a* is substantially aligned with a pair of articles B1, B2 disposed in the central, second row R2 of the group of articles B.

When the detachable panel 170*a* and the tear initiator 170*c* are removed first and second articles B1, B2 in the central row R2 are fully exposed to view.

In the illustrated embodiment the pair of articles B1, B2 which are fully exposed are centrally disposed in the second row R2. In other embodiments, a different pair of adjacent articles in the article group may be fully exposed, for example, but not limited to, an endmost pair of articles in the second row R2.

Articles B in the uppermost row R3 and lowermost row R1 adjacent to the pair of articles B1, B2 which are fully exposed may be partially exposed to view, in particular but not limited to an article in each of the uppermost and lowermost row R3, R1 which is disposed in contact with each of the first and second articles B1, B2.

The fully exposed articles (first article B1, second article B2) can be readily removed from the carton 190.

Removal of either one of the first and second articles B1, B2 will not affect the position of the remaining articles B. Due to the nested arrangement the other articles B will be held in their initial position.

However, subsequent removal of the other one of the first and second articles B1, B2, will release the group of articles B within the carton 190 such that the remaining articles B in the carton 190 cascade generally downward, towards the base panel 120. This movement of the articles B will allow removal of further articles B through the opening in the second side wall 118 created by removal of the detachable panel 170*a* and the tear initiator 170*c*.

Figure 9:
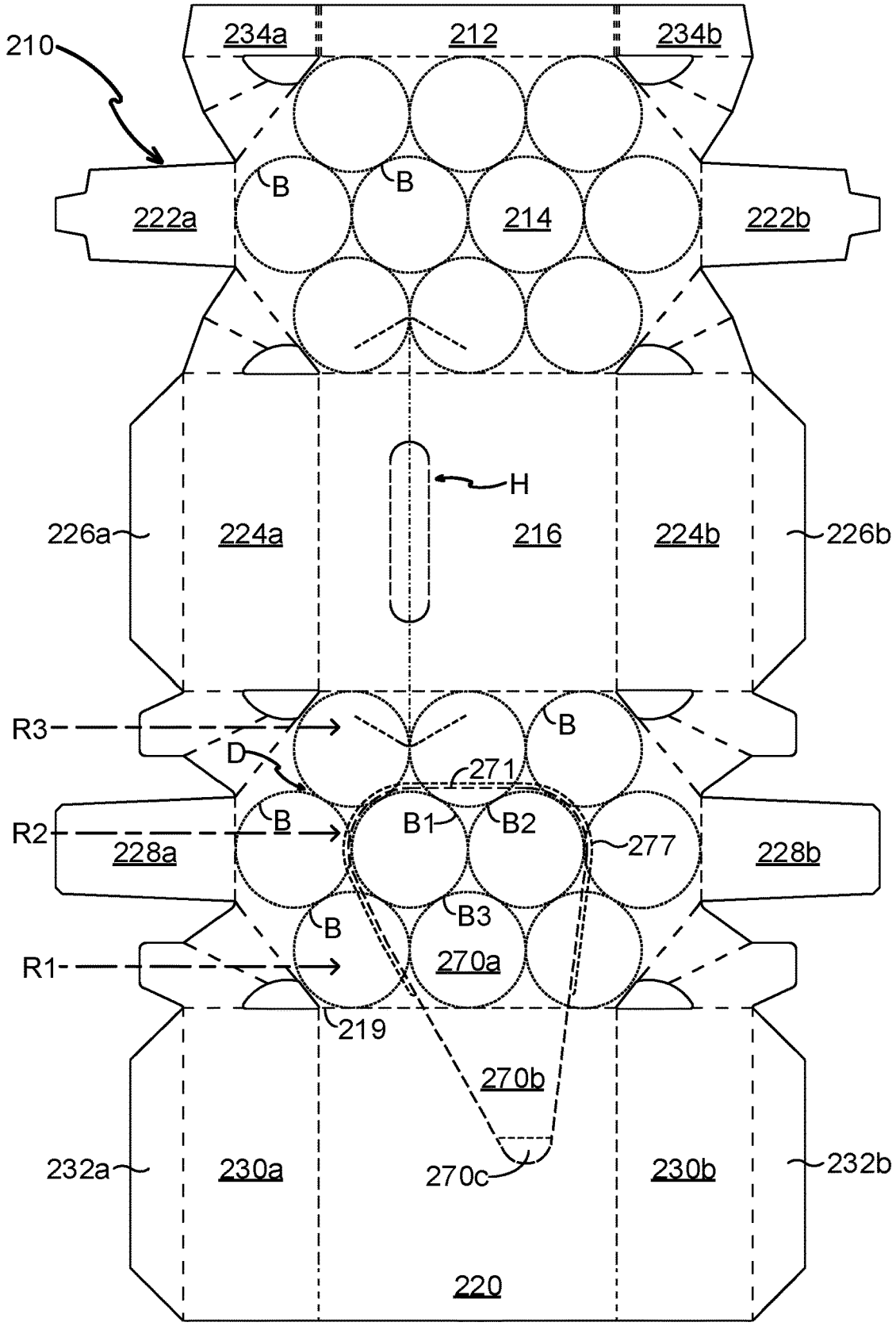
FIG. 9 is a plan view from above of the blank of FIG. 8 showing an arrangement of a plurality of articles with respect to top and bottom panels of the blank.

Referring now to FIGS. 8 to 10 there is shown an alternative embodiment of the present disclosure. In the third illustrated embodiment, like numerals have, where possible, been used to denote like parts, albeit with the addition of the prefix "200" to indicate that these features belong to the third embodiment. The third embodiment shares many common features with the embodiments of FIGS. 1 to 7, therefore only the differences from the embodiments illustrated in FIGS. 1 to 7 will be described in any greater detail.

FIG. 8 shows a blank 210 for forming an article carrier or carton 290 (see FIG. 10) according to a third embodiment. The blank 210 comprises a plurality of primary panels 212, 214, 216, 218, 220 for forming a tubular structure. The plurality of main panels 212, 214, 216, 218, 220 comprises a securing flap 212, a first side panel 214, a top panel 216, a second side panel 218, and a base panel 220. The plurality of main panels 212, 214, 216, 218, 220 may be hingedly connected to each other, one to the next, in a linear series by a respective one of a plurality of hinged connections in the form of fold lines 213, 215, 217, 219.

The blank 210 comprises an access device or dispenser D for gaining access to an interior of the carton 290 so as to be able to remove the carton contents.

The dispenser D comprises a detachable panel 270*a*/270*b*.

A first portion 270*a* of the detachable panel 270*a*/270*b* is struck from the second side panel 218 and a second portion 270*b* of the detachable panel 270*a*/270*b* is struck from the base panel 220. The second portion of the detachable panel 270*b* is hingedly connected to the first portion 270*a* by the fold line 219.

The detachable panel 270*a*/270*b* is defined in part by a first severance line or tear line 171 provided in the second side panel 218. The detachable panel 270*a*/270*b* is defined in part by a second severance line or tear line 273*a*/173*b* provided in the base panel 220. The second tear line 273*a*/273*b* comprises a first part 273*a* and a second part 273*b*; the first part 273*a* is divergently arranged with respect to the second part 273*b*.

The detachable panel 270*a*/270*b* and the tear initiator 270*c* define an opening, the opening takes the general form of a scalene triangle, albeit with rounded corners or vertices. In the illustrated embodiment the opening takes the general form of an acute triangle. In other embodiments opening may take other forms such as but not limited to obtuse triangle, right-angled triangle or other generally polygonal shape.

The first part 273*a* of the second tear line 273*a*/273*b* extends from a first location on the fold line 219 to a first end of a tear initiator 270*c* and a second part 273*b* of the second tear line 273*a*/273*b* extends from a second location on the fold line 219 to a second end of the tear initiator 270*c*.

The first tear line 271 is continuous or contiguous with first and second parts 273*a*, 273*b* of the second severance line 273*a*/273*b*.

The tear initiator 270*c* comprises a foldable tab 270*c* hinged to the second portion 270*b* of the detachable panel 270*a*/270*b* by a fold line 275. The foldable tab 270*c* is defined in part by a cutline, the cutline may be 'U' shaped or semi-circular; although in other embodiments other shapes may be employed. The cutline of the tear initiator is continuous or contiguous with first and second parts 273*a*, 273*b* of the second severance line 273*a*/273*b*; in this way a continuous, closed, loop is formed.

When the detachable panel 270*a*/270*b* and the tear initiator 270*c* are removed articles B in the lowermost row R1 are exposed to view. A central article B3 in the lowermost row R1 fully exposed to view. Articles in the lowermost row R1 adjacent to the central article B3 are partially exposed to view.

Each of a centrally disposed pair of articles B1, B2 in the second or middle row R2 is fully exposed to view, said articles B1, B2 are disposed in contact with, at least, the central article B3 in the lowermost row R1.

The articles B in the third or uppermost row R3 are substantially concealed from view when the detachable panel 270*a*/270*b* and the tear initiator 270*c* are initially removed.

The fully exposed articles (first article B1, second article B2 and third article B3) can be readily removed from the carton 290.

Removal of any one of the first, second and third articles B1, B2, B3 will not affect the position of the remaining articles B, due to the nested arrangement the other articles B will be held in their initial position.

However, subsequent removal of another one of the first, second and third articles B1, B2, B3 will release the group of articles B within the carton 290 such that the remaining articles B in the carton 290 cascade generally downward, towards the base panel 220. This movement of the articles B will allow removal of further articles B through the opening in the second side wall 218 created by removal of the detachable panel 270*a*/270*b* and the tear initiator 270*c*.

Referring now to FIGS. 11 and 12 there is shown an alternative embodiment of the present disclosure. In the fourth illustrated embodiment, like numerals have, where possible, been used to denote like parts, albeit with the addition of the prefix "300" to indicate that these features belong to the fourth embodiment. The fourth embodiment shares many common features with the embodiments of FIGS. 1 to 10, therefore only the differences from the embodiments illustrated in FIGS. 1 to 10 will be described in any greater detail.

FIG. 11 shows a blank 310 for forming an article carrier or carton 390 (see FIG. 12) according to a fourth embodiment. The blank 310 comprises a plurality of primary panels 312, 314, 316, 318, 320 for forming a tubular structure. The plurality of main panels 312, 314, 316, 318, 320 comprises a securing flap 312, a first side panel 314, a top panel 316, a second side panel 318, and a base panel 320. The plurality of main panels 312, 314, 316, 318, 320 may be hingedly connected to each other, one to the next, in a linear series by a respective one of a plurality of hinged connections in the form of fold lines 313, 315, 317, 319.

The blank 310 comprises an access device or dispenser D for gaining access to an interior of the carton 390 so as to be able to remove the carton contents.

The dispenser D comprises a removable or detachable panel 370*a*/370*b*.

The blank 310 comprises an access device or dispenser D for gaining access to an interior of the carton 390 so as to be able to remove the carton contents.

The dispenser D comprises a detachable panel 370*a*/370*b*. A first portion 370*a* of the detachable panel 370*a*/370*b* is struck from the second side panel 318 and a second portion 370*b* of the detachable panel 370*a*/370*b* is struck from the base panel 320. The second portion of the detachable panel 370*b* is hingedly connected to the first portion 370*a* by a portion of the fold line 19.

The detachable panel 370*a*/370*b* is defined in part by a first severance line or tear line 371 provided in the second side panel 318. The detachable panel 370*a*/370*b* is defined in part by a second severance line or tear line 373*a*/373*b* provided in the base panel 320. The second tear line 373*a*/373*b* comprises a first part 373*a* and a second part 373*b*; the first part 373*a* is divergently arranged with respect to the second part 373*b*.

The first part 373*a* of the second tear line 373*a*/373*b* extends from a first location on the fold line 319 to a first end of a tear initiator 370*c* and a second part 373*b* of the second tear line 373*a*/373*b* extends from a second location on the fold line 319 to a second end of the tear initiator 370*c*.

The tear initiator 370*c* comprises a foldable tab 370*c* hinged to the second portion 370*b* of the detachable panel 370*a*/370*b* by a fold line 375. The foldable tab 370*c* is defined in part by 'U' shaped or semi-circular outline, although in other embodiments other shapes may be employed.

The detachable panel 370*a*/370*b* and the tear initiator 370*c* define an opening, the opening takes the general form of an isosceles triangle, albeit with rounded corners or vertices. In other embodiments opening may take other forms for example but not limited to equilateral triangle, right-angled triangle, quadrilateral or other polygonal shapes.

The blank 310 may comprise at least one hinged connection in the form of a plurality of spaced apart partial depth cut lines 377*a*, 377*b*. In other embodiments, the hinged connection may be a score line, embossed or debossed line and defines foldable region in the second side panel 318 proximate the first severance line 371. A portion of the hinged connection may be arranged to form a parallel curve or offset curve with respect the first severance line 371. In the illustrated embodiment a pair of hinged connection are provided about curvilinear or arcuate portions of the first severance lines 371. In this way the hinged connection is similarly shaped to portions of the first severance line 371.

The first and second parts 373*a*, 373*b* of the second tear line 373*a*/373*b* extend into the second side panel so as to define continuous linear tear lines.

The first and second parts 373*a*, 373*b* of the second tear line 373*a*/373*b* define opposing side edges of the detachable or removable panel 370*a*/370*b* respectively.

The first part 373*a* of the second tear line 373*a*/373*b* is located closer to a first corner edge 355*a* of the second side panel 318 than the second part 373*b* of the second tear line 373*a*/73*b*. The first corner edge 355*a* of the second side panel 318 is defined by fold line 355*a* which hinges the thirteenth web panel 348*a* to the second side panel 318.

The first corner edge 355*a* extends obliquely with respect to the fold line 319 hinging the base panel 320 to the second side panel 318. An obtuse angle is defined between the first corner edge 355*a* and the fold line 319 between the base panel 320 and the second side panel 318.

A second corner edge 355*b* of the second side panel 318 is defined by fold line 355*b* which hinges the fifteenth web panel 348*b* to the second side panel 318. The second part 373*b* of the second tear line 373*a*/373*b* is located closer to the second corner edge 355*b* of the second side panel 318 than the first part 373*a* of the second tear line 373*a*/373*b*.

The second corner edge 355*b* extends obliquely with respect to the fold line 319 hinging the base panel 320 to the second side panel 318. An obtuse angle is defined between the second corner edge 355*b* and the fold line 319 between the base panel 320 and the second side panel 318.

When the detachable panel 370*a*/370*b* and the tear initiator 370*c* are removed articles B in the lowermost row R1 are exposed to view. A first, central, article B2 in the lowermost row R1 is fully exposed to view. One of the articles B1 (also referred to herein as second article B1) in the lowermost row R1 adjacent to the first central article B2 is also fully exposed to view.

An article B in a second row R2 (the lowermost row R2 of the two inner rows R2, R3) is partially exposed to view, said article B is disposed in contact with, at least, the central article B2 in the lowermost row R1. The article B is disposed in contact with, at least, the first article B2 and the second article B1.

The articles B in the third and fourth rows R3, R4 (the uppermost row R3 of the two inner rows R2, R3 and the uppermost row R4) are substantially concealed from view when the detachable panel 370*a*/370*b* and the tear initiator 370*c* are initially removed.

The fully exposed articles (first article B2, second article B1) can be readily removed from the carton 390.

Removal of either one of the first and second articles B1, B2 will not affect the position of the remaining articles B. Due to the nested arrangement the other articles B will be held in their initial position.

However, subsequent removal of the other one of the first and second articles B1, B2, will release the group of articles B within the carton 390 such that the remaining articles B in the carton 390 cascade generally downward, towards the base panel 320. This movement of the articles B will allow removal of further articles B through the opening in the second side wall 318 created by removal of the detachable panel 370*a*/370*b* and the tear initiator 370*c*.

Referring now to FIGS. 13 to 15 there are shown alternative embodiments of the present disclosure. In the fifth, sixth and seventh illustrated embodiments, like numerals have, where possible, been used to denote like parts, albeit with the addition of the prefixes "400", "500" and "600" to indicate that these features belong to the fifth, sixth and seventh embodiments respectively. The embodiments share many common features with the embodiments of FIGS. 1 to 12, therefore only the differences from the embodiments illustrated in FIGS. 1 to 12 will be described in any greater detail.

FIG. 13 shows a blank 410 for forming an article carrier or carton (not shown) according to a fourth embodiment. The blank 410 comprises a plurality of primary panels 412, 414, 416, 418, 420 for forming a tubular structure. The plurality of main panels 412, 414, 416, 418, 420 comprises a securing flap 412, a first side panel 414, a top panel 416, a second side panel 418, and a base panel 420. The plurality of main panels 412, 414, 416, 418, 420 may be hingedly connected to each other, one to the next, in a linear series by a respective one of a plurality of hinged connections in the form of fold lines 413, 415, 417, 419.

The blank 410 comprises at least one access device or dispenser D1, D2 for gaining access to an interior of the carton so as to be able to remove the carton contents. The illustrated embodiment comprises two access devices D1, D2. A first access device D1 is defined in the first side panel 414. A second access device D2 is defined in the second side panel 418. It will be appreciated that the blank 410 may comprise only one of the illustrated access devices D1, D2; or may comprise a pair of either the first access device D1 or the second access device D2, wherein one of the pair of access devices is defined the first side panel 414 and the other of the pair is defined in the second side panel 418.

The first access device D1 comprises a removable or detachable panel 470*d* defined in the first side panel 414.

The detachable panel 470*d* is struck from the first side panel 414. The detachable panel 470*d* extends from the fold line 413 hinging the first side panel 414 to the securing panel 412. The detachable panel 470*d* may be considered to interrupt the fold line 413.

The detachable panel 470*d* is defined in part by a first severance line or tear line 471*a* provided in the first side panel 414. The detachable panel 470*d* is defined in part by a second severance line or tear line 413*a*. The second severance line 413*a* is collinear and/or coextensive with the fold line 413. The second severance line 413*a* may be considered to interrupt the fold line 413.

The first access device D1 comprises a tear initiator 470*e*. The tear initiator 470*e* is struck from, or defined in, the top panel 416. The tear initiator 470*e* comprises a tab 470*e* hingedly connected to the detachable panel 470*d* by a hinged connection in the form of a fold line 475*a*. The fold line 475*a* may be collinear and/or coextensive with the fold line 415 hinging the top panel 416 to the first side panel 414. The tab 470*e* may be defined in part by 'U' shaped or semi-circular outline 479*a*, although in other embodiments other shapes may be employed.

The tab 470*e* may be positioned such that when the blank 410 is formed into a carton, the tab 470*c* is located adjacent a gap or void between the top wall 416 and an adjacent pair of articles B3 in the uppermost row R3 of the article group. The void may be created in part due to the shape of the articles B, in the illustrated embodiment the cylindrical shape may create the void although in other embodiments other shapes could be employed.

The detachable panel 470*d* extends from the fold line 413 across the first side panel to the fold line 415, in a set up carton the detachable panel 470*d* defines an opening extending from the base wall 420 to the top wall 416.

The first tear line 471*a* comprises a first linear portion and a second linear portion defining opposing side edges of the detachable or removable panel 470*d*. The first linear portion may be generally parallel to the second linear portion. The first and second linear portions may be obliquely oriented with respect to the fold lines 413, 419.

The first linear portion of the first tear line 471*a* is located closer to a first corner edge 441*a* of the first side panel 414 than the second linear portion of the first tear line 471*a*. The first corner edge 441*a* of the first side panel 414 is defined by fold line 441*a* which hinges the second web panel 438*a* to the first side panel 414.

The first corner edge 441*a* extends obliquely with respect to the fold line 413 hinging the securing panel 412 to the first side panel 414. An obtuse angle is defined between the first corner edge 441*a* and the fold line 413 between the securing panel 412 and the first side panel 414.

A second corner edge 441*b* of the first side panel 414 is defined by fold line 441*b* which hinges the fourth web panel 438*b* to the first side panel 414. The second linear portion of the first tear line 471*a* is located closer to the second corner edge 441*b* of the first side panel 414 than the first linear portion of the first tear line 471*a*.

The second corner edge 441*b* extends obliquely with respect to the fold line 413 hinging the securing panel 412 to the first side panel 414. An obtuse angle is defined between the second corner edge 441*b* and the fold line 413 between the securing panel 412 and the first side panel 414.

The detachable panel 470*d* and the tear initiator 470*e* define an opening, the opening takes the general form of an elongate slot extending obliquely across the first side panel 414.

When the detachable panel 470*d* and the tear initiator 470*e* are removed at least one article B in the carton is exposed to view. A first, central, article B1 in the lowermost row R1 is fully exposed to view. One or both of the articles B in the lowermost row R1 adjacent to the first central article B1 may also be partially exposed to view.

A second article B2 in a second row R2 (the central row R2) is fully exposed to view, the second article B2 is disposed in contact with, at least, the central article B1 in the lowermost row R1. One or both of the articles B in the second row R2 adjacent to the second article B2 may also be partially exposed to view.

A third article B3 in a third row R3 (the uppermost row R3) is fully exposed to view, the third article B3 is disposed in contact with, at least, the second article B2 in the second row R2. At least one article B in the third row R3 adjacent to the third article B3 may also be partially exposed to view.

The fully exposed articles (first article B1, second article B2 and third article B3) can be readily removed from the carton.

Removal of any one of the first, second and third articles B1, B2, B3 will not affect the position of the remaining articles B. Due to the nested arrangement the other articles B will be held in their initial position.

Removal of either one of the first and second articles B1, B2, will not affect the position of the remaining articles B. Due to the nested arrangement the other articles B will be held in their initial position. However, subsequent removal of the other one of the first and second articles B1, B2, will release the group of articles B within the carton such that the remaining articles in the carton cascade generally downward, towards the base panel 420. This movement of the articles B will allow removal of further articles B through the opening in the first side wall 418 created by removal of the detachable panel 470*d* and the tear initiator 470*e*.

The second access device D2 comprises a removable or detachable panel 470*a*/470*b*. A first portion 470*a* of the detachable panel 470*a*/470*b* is struck from the second side panel 418 and a second portion 470*b* of the detachable panel 470*a*/470*b* is struck from the base panel 420. The second portion of the detachable panel 470*b* is hingedly connected to the first portion 470*a* by a portion of the fold line 419.

The detachable panel 470*a*/470*b* is defined in part by a first severance line or tear line 471*b* provided in the second side panel 418. A portion 417*a* of the first severance line 471*b* is collinear and/or coextensive with the fold line 417. The first severance line 471*b* may be considered to interrupt the fold line 417. The detachable panel 470*a*/470*b* is defined in part by a second severance line or tear line provided in the base panel 420. The second tear line comprises a first part and a second part; the first part is divergently arranged with respect to the second part.

The first part of the second tear line extends from a first location on the fold line 419 to a first end of a tear initiator 470*c* and a second part of the second tear line extends from a second location on the fold line 419 to a second end of the tear initiator 470*c*. The first and second parts of the second tear line extend into the second side panel 418 so as to define continuous linear tear lines. The first and second parts of the second tear line define opposing side edges of the detachable or removable panel 470*a*/470*b* respectively.

The tear initiator 470*c* comprises a foldable tab 470*c* hinged to the second portion 470*b* of the detachable panel 470*a*/470*b* by a fold line 475*b*. The foldable tab 470*c* is defined in part by 'U' shaped or semi-circular outline 479*b*, although in other embodiments other shapes may be employed.

The detachable panel 470*a*/470*b* and the tear initiator 470*c* define an opening, the opening takes the general form of an isosceles triangle, albeit with rounded corners or vertices. In other embodiments opening may take other forms for example but not limited to equilateral triangle, right-angled triangle, quadrilateral or other polygonal shapes.

When the detachable panel 470*a*/470*b* and the tear initiator 470*c* are removed articles in the lowermost row R1 are exposed to view. A pair of adjacent articles B in the lowermost row R1 are partially exposed to view. One of the pair of articles partially exposed to view is the first article B1 which is fully exposed to view by the first access device D1.

The second article B2 in a second row R2 (the central row R2) is fully exposed to view.

The third article B3 in a third row R3 (the uppermost row R3) is fully exposed to view.

A fourth article B4 in the third row R3 adjacent to the third article B3 is also be fully exposed to view. The fourth article B4 may be an article B which is partially exposed to view by the first access device D1. The third and fourth articles B3, B4 are in touching contact with the second article B2.

The fully exposed articles (second article B2, third article B3 and fourth article B4) can be readily removed from the carton.

Removal of any one of the second, third and fourth articles B2, B3, B4 will not affect the position of the remaining articles B. Due to the nested arrangement the other articles B will be held in their initial position.

Removal of either one of the second and third articles B2, B3 will not affect the position of the remaining articles B. Due to the nested arrangement the other articles B will be held in their initial position.

However, subsequent removal of the other one of the second and third articles B2, B3, will release the group of articles B within the carton such that the remaining articles B in the carton cascade generally downward, towards the base panel 420. This movement of the articles B will allow removal of further articles B through the opening in the second side wall 418 created by removal of the detachable panel 470*a*/470*b* and the tear initiator 470*c*.

In the embodiment of FIG. 13 the handle structure of the previous embodiments has been omitted. It will be appreciated that the blank 410 may comprise a handle structure in alternative embodiments, such handle structure may take the form of the previous embodiments or an alternative suitable handle structure.

FIG. 14 shows a blank 510 for forming an article carrier or carton (not shown) according to a fifth embodiment. The blank 510 comprises a plurality of primary panels 512, 514, 516, 518, 520 for forming a tubular structure. The plurality of main panels 512, 514, 516, 518, 520 comprises a securing flap 512, a first side panel 514, a top panel 516, a second side panel 518, and a base panel 520. The plurality of main panels 512, 514, 516, 518, 520 may be hingedly connected to each other, one to the next, in a linear series by a respective one of a plurality of hinged connections in the form of fold lines 513, 515, 517, 519.

The blank 510 comprises at least one access device or dispenser D1, D2 for gaining access to an interior of the carton so as to be able to remove the carton contents. The illustrated embodiment comprises two access devices D1, D2. A first access device D1 is defined in the first side panel 514. A second access device D2 is defined in the second side panel 518. It will be appreciated that the blank 510 may comprise only one of the illustrated access devices D1, D2; or may comprise a pair of either the first access device D1 or the second access device D2, wherein one of the pair of access devices is defined the first side panel 514 and the other of the pair is defined in the second side panel 518.

The first access device D1 comprises a removable or detachable panel 570*d* defined in the first side panel 514. The first access device D1 is substantially similar to the first access device of the fourth embodiment and will not be described in further detail.

The second access device D2 comprises a removable or detachable panel 570*a*/570*b*. A first portion 570*a* of the detachable panel 570*a*/570*b* is struck from the second side panel 518 and a second portion 570*b* of the detachable panel 570*a*/570*b* is struck from the top panel 516. The second portion of the detachable panel 570*b* is hingedly connected to the first portion 470*a* by a portion of the fold line 517.

The second access device D2 is substantially similar to the second access device D2 of the embodiment of FIG. 13 albeit inverted.

The detachable panel 570*a*/570*b* is defined in part by a first severance line or tear line 571*b* provided in the second side panel 518. A portion 519*a* of the first severance line 571*b* is collinear and/or coextensive with the fold line 519. The first severance line 571*b* may be considered to interrupt the fold line 519. The detachable panel 570*a*/570*b* is defined in part by a second severance line or tear line provided in the top panel 516. The second tear line comprises a first part and a second part; the first part is divergently arranged with respect to the second part.

The detachable panel 570*a*/570*b* and the tear initiator 570*c* define an opening, the opening takes the general form of an isosceles triangle, albeit with rounded corners or vertices. In other embodiments opening may take other forms for example but not limited to equilateral triangle, right-angled triangle, quadrilateral or other polygonal shapes.

When the detachable panel 570*a*/570*b* and the tear initiator 570*c* are removed articles in the lowermost row R1 are exposed to view. A pair of adjacent articles B in the lowermost row R1 are fully exposed to view. One of the pair of articles fully exposed to view is the first article B1 which is fully exposed to view by the first access device D1. A fourth article B4 is disposed in touching contact with the first article B1 and may be an endmost article in the lowermost row R1.

The second article B2 in a second row R2 (the central row R2) is fully exposed to view.

The third article B3 in a third row R3 (the uppermost row R3) is partially exposed to view. An article adjacent to the third article B3 is partially exposed to view.

A fourth article B4 in the third row R3 adjacent to the third article B3 is also be fully exposed to view. The fourth article B4 may be an article B which is partially exposed to view by the first access device D1. The third and fourth articles B3, B4 are in touching contact with the second article B2.

The fully exposed articles (second article B2, third article B3 and fourth article B4) can be readily removed from the carton.

Removal of any one of the first, second and fourth articles B1, B2, B4 will not affect the position of the remaining articles B. Due to the nested arrangement the other articles B will be held in their initial position.

However, subsequent removal of another one of first, second and fourth articles B1, B2, B4 will release the group of articles B within the carton such that the remaining articles in the carton cascade generally downward, towards the base panel 520. This movement of the articles B will allow removal of further articles B through the opening in the second side wall 518 created by removal of the detachable panel 570*a*/570*b* and the tear initiator 570*c*.

FIG. 15 shows a blank 610 for forming an article carrier or carton (not shown) according to a fifth embodiment. The blank 510 comprises a plurality of primary panels 612, 614, 616, 618, 620 for forming a tubular structure. The plurality of main panels 612, 614, 616, 618, 620 comprises a securing flap 612, a first side panel 614, a top panel 616, a second side panel 618, and a base panel 620. The plurality of main panels 612, 614, 616, 618, 620 may be hingedly connected to each other, one to the next, in a linear series by a respective one of a plurality of hinged connections in the form of fold lines 613, 615, 617, 619.

The blank 610 comprises at least one access device or dispenser D1, D2 for gaining access to an interior of the carton so as to be able to remove the carton contents. The illustrated embodiment comprises two access devices D1, D2. A first access device D1 is defined in the first side panel 614. A second access device D2 is defined in the second side panel 618. It will be appreciated that the blank 610 may comprise only one of the illustrated access devices D1, D2; or may comprise a pair of either the first access device D1 or the second access device D2, wherein one of the pair of access devices is defined the first side panel 614 and the other of the pair is defined in the second side panel 618.

The first access device D1 comprises a removable or detachable panel 670*d* defined in the first side panel 614. The first access device D1 is substantially similar to the first access device of the fourth embodiment albeit the tear initiator of the fourth embodiment has been omitted.

The first access device D1 comprises a removable or detachable panel 670*d*. The detachable panel 670*d* is struck from the first side panel 614.

The detachable panel 670*d* is defined in part by a first severance line or tear line 671*a* provided in the first side panel 614. A first portion 613*a* of the first severance line 671*a* is collinear and/or coextensive with the fold line 613. The first severance line 671*a* may be considered to interrupt the fold line 613. A second portion 615*a* of the first severance line 671*a* is collinear and/or coextensive with the fold line 615. The first severance line 671*a* may be considered to interrupt the fold line 615.

The detachable panel 670*d* extends from the fold line 613 across the first side panel to the fold line 615, in a set up carton the detachable panel 670*d* defines an opening extending from the base wall 620 to the top wall 616.

The first tear line 671*a* comprises a first linear portion and a second linear portion defining opposing side edges of the detachable or removable panel 670*d*. The first linear portion may be generally parallel to the second linear portion. The first and second linear portions may be obliquely oriented with respect to the fold lines 613, 619.

The detachable panel 670*d* defines an opening, the opening takes the general form of an elongate slot extending obliquely across the first side panel 614.

When the detachable panel 670*d* is removed at least one article B in the carton is exposed to view. A first, central, article B1 in the lowermost row R1 is fully exposed to view. One or both of the articles B in the lowermost row R1 adjacent to the first central article B1 may also be partially exposed to view.

A second article B2 in a second row R2 (the central row R2) is fully exposed to view, the second article B2 is disposed in contact with, at least, the central article B1 in the lowermost row R1. One or both of the articles B in the second row R2 adjacent to the second article B2 may also be partially exposed to view.

A third article B3 in a third row R3 (the uppermost row R3) is fully exposed to view, the third article B3 is disposed in contact with, at least, the second article B2 in the second row R2. At least one article B in the third row R3 adjacent to the third article B3 may also be partially exposed to view.

The fully exposed articles (first article B1, second article B2 and third article B3) can be readily removed from the carton.

Removal of any one of the first, second and third articles B1, B2, B3 will not affect the position of the remaining articles B. Due to the nested arrangement the other articles B will be held in their initial position.

Removal of either one of the first and second articles B1, B2, will not affect the position of the remaining articles B. Due to the nested arrangement the other articles B will be held in their initial position. Removal of the other one of the first and second articles B1, B2, will release the group of articles B within the carton such that the remaining articles B in the carton cascade generally downward, towards the base panel 620. This movement of the articles B will allow removal of further articles B through the opening in the first side wall 614 created by removal of the detachable panel 670*d*.

The second access device D2 comprises a removable or detachable panel 670*a*/670*b*. A first portion 670*a* of the detachable panel 670*a*/670*b* is struck from the second side panel 618 and a second portion 670*b* of the detachable panel 670*a*/670*b* is struck from the top panel 616. The second portion of the detachable panel 670*b* is hingedly connected to the first portion 670*a* by a portion of the fold line 519.

The detachable panel 670*a*/670*b* is defined in part by a first severance line or tear line 671*b* provided in the second side panel 618. A portion 617*a* of the first severance line 671*b* is collinear and/or coextensive with the fold line 617. The first severance line 671*b* may be considered to interrupt the fold line 617. The detachable panel 670*a*/670*b* is defined in part by a second severance line 673*a*/673*b* or tear line provided in the base panel 520. The second tear line 673*a*/673*b* comprises a first part 673*a* and a second part 673*b*; the first part 673*a* is divergently arranged with respect to the second part 673*b*.

The first part 673*a* of the second tear line 673*a*/673*b* extends from a first location on the fold line 619 to a first end of a tear initiator 670*c* and the second part 673*b* of the second tear line 673*a*/673*b* extends from a second location on the fold line 619 to a second end of the tear initiator 670*c*. The first and second parts 673*a*, 673*b* of the second tear line 673*a*/673*b* extend into the second side panel 618 so as to define continuous linear tear lines. The first and second parts 673*a*, 673*b* of the second tear line 673*a*/673*b* define opposing side edges of the detachable or removable panel 670*a*/670*b* respectively.

The tear initiator 670*c* comprises a foldable tab 670*c* hinged to the second portion 670*b* of the detachable panel 670*a*/670*b* by a fold line 675. The foldable tab 670*c* is defined in part by 'U' shaped or semi-circular outline, although in other embodiments other shapes may be employed.

The detachable panel 670*a*/670*b* and the tear initiator 670*c* define an opening, the opening takes the general form of an elongate slot tapered at one end.

When the detachable panel 670*a*/670*b* and the tear initiator 670*c* are removed the first, central, article B1 in the lowermost row R1 is fully exposed to view.

The second article B2 in a second row R2 (the central row R2) is fully exposed to view.

The third article B3 in a third row R3 (the uppermost row R3) is fully exposed to view.

The fully exposed articles (first article B1, second article B2 and third article B3) can be readily removed from the carton.

Removal of any one of the first, second and third articles B1, B2, B3 will not affect the position of the remaining articles B. Due to the nested arrangement the other articles B will be held in their initial position.

Removal of either one of the first and second articles B1, B2, will not affect the position of the remaining articles B. Due to the nested arrangement the other articles B will be held in their initial position. Removal of the other one of the first and second articles B1, B2, will release the group of articles B within the carton such that the remaining articles in the carton cascade generally downward, towards the base panel 620. This movement of the articles B will allow removal of further articles B through the opening in the second side wall 618 created by removal of the detachable panel 670*a*/670*b*.

The present disclosure provides a package comprising a carton or article carrier 90; 190; 290; 390 loaded with one or more articles B. The carton 90; 190; 290; 390 comprises a plurality of main or primary panels defining an interior of the carton 90; 190; 290; 390.

The package comprises a group of generally cylindrical articles B each having an end and a cylindrical side. The carton 90; 190; 290; 390 disposed at least partially around the group of articles B. The carton comprises a plurality of panels including a bottom wall 20; 120; 220; 320; 420; 520; 620, a top wall 16; 116; 216; 316; 416; 516; 616, first and second opposed side walls 14, 18; 114; 118; 214; 218; 314, 318; 414, 418; 514, 518; 614, 618 and first and second opposed end walls, wherein the group of articles are arranged in a plurality of rows of articles comprising a first row R1 and a second row R2, the first row R1 extends along the bottom wall such that the articles of the first row R1 are disposed at the cylindrical sides thereof in contact with the bottom wall and at the ends thereof adjacent to the side wall, the second row R2 being disposed on the first row R1 such that the articles of the second row R2 are disposed at the ends thereof adjacent to the side wall and are nested with the articles of the first row R1. Each of the first and second rows R1, R2 includes a pair of first and second end articles B1, B2 at opposite ends of the respective row. The first side wall of the carton is disposed in contact with the first end articles of the first and second rows, the second side wall of the carton is disposed in contact with the second end articles of the first and second rows. The carton further comprises an article dispensing feature which comprises a removable panel detachably connected at least in part to the side wall so as to define a dispenser opening in the side wall through which the articles of the group may exit from the carton. The dispenser opening is positioned and sized such that the ends of at least one of the articles in the first row and of at least another one of the articles in the group are exposed to view for removal through the dispenser opening.

The second row R2 may comprise at least one more article B than the first row R1.

The first end wall comprises a first portion 30*b* and a second portion 22*b*/28*b*, the first portion 30*b* is oblique with respect to the bottom wall 20 and is in contact with a first endmost article of the first row R1.

The first portion 30*b* extends between the bottom wall 20 and the second portion 22*b*/28*b*, the second portion 22*b*/28*b* being disposed generally perpendicular to the bottom wall 20 and being in contact with a first endmost article of the second row R2.

The second end wall comprises a first portion 30*a* and a second portion 22*a*/28*a*, the first portion 30*a* of the second end wall is oblique with respect to the bottom wall 20 and is in contact with a second endmost article of the first row R1.

The first portion 30*a* of the second end wall extends between the bottom wall 20 and the second portion 22*a*/28*a* of the second end wall. The second portion 22*a*/28*a* of the second end wall is disposed generally perpendicular to the bottom wall 20 and is in contact with a second endmost article of the second row R2.

The group of articles further comprises a third row R3 disposed on the second row R2 such that the articles of the third row R3 are disposed at the ends thereof adjacent to the side wall 14, 18 and are nested with the articles of the second row R2.

The group of articles may further comprise a third row R3 disposed on the second row R2 such that the articles B of the third row R3 are disposed at the ends thereof adjacent to the side wall 14, 18 and are in vertical alignment respectively with the articles B of the second row R2 and wherein the at least another one of the articles B in the group is at least another one of the article of the first row R1.

The dispenser opening has a maximum length $L_1$ extending along the side wall, the maximum length $L_1$ being equal to or greater than twice the maximum diameter of each article of the group.

The dispenser opening has a width $W_1$ extending perpendicularly to the maximum length along the side wall, the width $W_1$ being equal to or greater than the maximum diameter.

It can be appreciated that various changes may be made within the scope of the present invention. For example, the size and shape of the panels may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A package comprising a carton or article carrier loaded with one or more articles, the package comprising a group of generally cylindrical articles each having an end and a cylindrical side, the carton being disposed at least partially around the group of articles B, the carton comprising a plurality of panels including a bottom wall, a top wall, first and second opposed side walls and first and second opposed end walls, wherein the group of articles are arranged in a plurality of rows of articles comprising a first row and a second row, the first row extends along the bottom wall such that the cylindrical sides of the articles of the first row are disposed in contact with the bottom wall and such that the ends of the articles of the first row are disposed adjacent to and at least partially in contacting relationship with one of the opposed side walls, the second row being disposed on the first row such that the ends of the articles of the second row are disposed adjacent to and at least partially in contacting relationship with one of the opposed side walls and are nested with the articles of the first row, each of the first and second rows includes a pair of first and second endmost articles at opposite ends of the respective row, the first end wall of the carton is disposed in contact with the first endmost articles of the first and second rows, the second end wall of the carton is disposed in contact with the second endmost articles of the first and second rows, the carton further comprises an article dispensing feature which comprises a removable panel detachably connected at least in part to one of the opposed side walls so as to define a dispenser opening in said one of the opposed side walls, the articles of the group may exit from the carton through the dispenser opening, the dispenser opening is positioned and sized such that the ends of at least one of the articles in the first row and of at least another one of the articles in the group are exposed to view for removal through the dispenser opening.

2. A carton according to claim 1, wherein the second row may comprise at least one more article than the first row.

3. A carton according to claim 1, wherein the first end wall comprises a first portion and a second portion, the first portion is oblique with respect to the bottom wall and is in contact with a first endmost article of the first row.

4. A carton according to claim 3, wherein the first portion extends between the bottom wall and the second portion, the second portion being disposed generally perpendicular to the bottom wall and being in contact with the first endmost article of the second row.

5. A carton according to claim 1, wherein the second end wall comprises a first portion and a second portion, the first portion of the second end wall is oblique with respect to the bottom wall and is in contact with the second endmost article of the first row.

6. A carton according to claim 5, wherein the first portion of the second end wall extends between the bottom wall and the second portion of the second end wall, the second portion of the second end wall is disposed generally perpendicular to the bottom wall and is in contact with the second endmost article of the second row.

7. A carton according to claim 1, wherein the group of articles further comprises a third row disposed on the second row such that the articles of the third row are disposed at the ends thereof adjacent to the side wall and are nested with the articles of the second row.

8. A carton according to claim 1, wherein the group of articles may further comprise a third row disposed on the second row such that the articles of the third row are disposed at the ends thereof adjacent to the side wall and are in vertical alignment respectively with the articles of the second row and wherein the at least another one of the articles in the group is at least another one of the article of the first row.

9. A carton according to claim 1, wherein the dispenser opening has a maximum length extending along the side wall, the maximum length being equal to or greater than twice the maximum diameter of each article of the group.

10. A carton according to claim 1, wherein the dispenser opening has a width extending perpendicularly to the maximum length along the side wall, the width being equal to or greater than the maximum diameter.

11. A carton according to claim 1 wherein the dispenser opening is defined solely in said one of the opposed side walls.

12. A carton according to claim 1 wherein the first endmost article of the second row is enclosed by the first end wall and the second endmost article of the second row is enclosed by the opposed second end wall.

13. A carton according to claim 1 wherein the first and the second opposed end walls foldably attached solely to a central portion of the first and the second opposed side walls.

14. A blank for forming a carton, which comprises a bottom wall and two opposed side walls, for packaging a group of articles arranged in two or more rows, wherein a first row of the two or more rows is configured to extend along the bottom wall such that cylindrical sides of the articles of the first row are configured to be disposed in contact with the bottom wall and such that ends of the articles of the first row are configured to be disposed adjacent to and at least partially in contacting relationship with one of the opposed side walls, and a second row of the two or more rows is configured to be disposed on the first row such that the ends of the articles of the second row are configured to be disposed adjacent to and at least partially in contacting relationship with one of the opposed side walls, the blank comprising a plurality of primary panels for defining an interior of the carton, the plurality of panels comprising:

a bottom wall panel;

a top wall panel;

first and second opposed side walls panels; and first and second opposed end walls panels;

wherein the blank further comprises:

an article dispensing feature which comprises:

a removable panel detachably connected at least in part to one of the opposed side wall panels so as to define a dispenser opening in said one of the opposed side wall panels, the dispenser opening is positioned and sized such that the ends of at least one article in the first row and of at least another one of the articles in the group are exposed to view for removal through the dispenser opening in a setup carton such that the articles of the group may exit from the carton through the dispenser opening.

15. A blank according to claim 14 wherein the dispenser opening is defined solely in said one of the opposed side wall panels.

16. A blank according to claim 14 further comprising;

a securing flap hingedly connected to one of the first and the second opposed side wall panels;

a first securing tab hingedly connected to a first end of the securing flap; and a second securing tab hingedly connected to a second end of the securing flap that opposes the first end of the securing flap.

* * * * *